US012065774B2

(12) United States Patent
Jung et al.

(10) Patent No.: US 12,065,774 B2
(45) Date of Patent: Aug. 20, 2024

(54) LAUNDRY TREATING APPARATUS

(71) Applicant: LG Electronics Inc., Seoul (KR)

(72) Inventors: Sungwoon Jung, Seoul (KR); Hyehyun Sim, Seoul (KR); Hunjun Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/484,772

(22) Filed: Sep. 24, 2021

(65) Prior Publication Data

US 2022/0098782 A1 Mar. 31, 2022

(30) Foreign Application Priority Data

Sep. 25, 2020 (KR) ..... 10-2020-0124476

(51) Int. Cl.

| | |
|---|---|
| ***D06F 39/02*** | (2006.01) |
| *D06F 21/04* | (2006.01) |
| *D06F 33/37* | (2020.01) |
| *D06F 105/42* | (2020.01) |

(52) U.S. Cl.

CPC ..... *D06F 39/02* (2013.01); *D06F 39/028* (2013.01); *D06F 21/04* (2013.01); *D06F 33/37* (2020.02); *D06F 2105/42* (2020.02)

(58) Field of Classification Search

CPC ..... D06F 39/022; D06F 39/028; D06F 39/02

See application file for complete search history.

(56) References Cited

U.S. PATENT DOCUMENTS 2,740,444 A * 4/1956 Martinelli ..... B65D 43/0212 220/792
5,356,026 A * 10/1994 Andress ..... B65D 21/0233 206/508

(Continued)

FOREIGN PATENT DOCUMENTS

| | | |
|---|---|---|
| CN | 202744828 | 2/2013 |
| CN | 104674513 | 11/2014 |

(Continued)

OTHER PUBLICATIONS

Machine translation of KR 100733307 B1, dated Sep. 2006. (Year: 2006).*

(Continued)

*Primary Examiner* — Michael E Barr
*Assistant Examiner* — Kevin G Lee
(74) *Attorney, Agent, or Firm* — Fish & Richardson P.C.

(57) ABSTRACT

A laundry treating apparatus includes a cabinet having a detergent opening defined a front surface thereof, a tub located inside the cabinet, a drum rotatably disposed inside the tub, and a storage for storing detergent to be supplied to the tub therein. The storage is retracted into or extended out of the cabinet through the detergent opening. The storage includes a storage frame having a detergent storage space defined therein for storing the detergent therein, where a top surface of the storage frame is opened such that the detergent storage space is opened, a cover seat portion formed on the storage frame and formed along a perimeter of the detergent storage space, and a cover detachably coupled to the cover seat portion to shield at least a portion of an open top surface of the detergent storage space.

18 Claims, 15 Drawing Sheets

(56) References Cited

U.S. PATENT DOCUMENTS

| | | | | |
|---|---|---|---|---|
| 7,357,272 | B2 * | 4/2008 | Maxwell | B65D 51/1666 220/366.1 |
| 2007/0056329 | A1 * | 3/2007 | Song | D06F 39/02 68/17 R |
| 2010/0000578 | A1 * | 1/2010 | Hendrickson | D06F 39/022 68/12.18 |
| 2011/0023241 | A1 * | 2/2011 | Lim | D06F 58/44 68/200 |
| 2018/0044840 | A1 | 2/2018 | Song et al. | |
| 2019/0368110 | A1 | 12/2019 | Wang et al. | |
| 2020/0232145 | A1 | 7/2020 | Jung et al. | |

FOREIGN PATENT DOCUMENTS

| | | |
|---|---|---|
| CN | 105442266 | 3/2016 |
| CN | 106637835 | 5/2017 |
| CN | 109923259 | 6/2019 |
| DE | 202013012060 | 2/2015 |
| KR | 10-2006-0100617 | 6/2007 |
| KR | 100733307 | 6/2007 |
| WO | WO2019128725 | 7/2019 |

OTHER PUBLICATIONS

Machine translation of CN 202744828 U, dated Feb. 2013. (Year: 2013).*

Machine translation of KR20060100617A, dated Sep. 2006. (Year: 2006).*

Extended European Search Report in European Appln. No. 21198488.5, dated Feb. 16, 2022, 9 pages.

Office Action in Chinese Appln. No. 202111120127.3, mailed on Mar. 23, 2023, 19 pages(with English translation).

Notice of Allowance in Chinese Appln. No. 202111120127.3, mailed on Jan. 18, 2024, 14 pages (with English translation).

* cited by examiner

LAUNDRY TREATING APPARATUS

CROSS-REFERENCE TO RELATED APPLICATIONS

This application claims the benefit of Korean Patent Application No. 10-2020-0124476, filed on Sep. 25, 2020, which is hereby incorporated by reference as if fully set forth herein.

TECHNICAL FIELD

The present disclosure relates to a laundry treating apparatus, and to a laundry treating apparatus having a detergent feeder.

BACKGROUND

A laundry treating apparatus is an apparatus that puts clothes, bedding, and the like (hereinafter, referred to as laundry) into a drum to remove contamination from the laundry. The laundry treating apparatus may perform processes such as washing, rinsing, dehydration, drying, and the like. The laundry treating apparatuses may be classified into a top loading type laundry treating apparatus and a front loading type laundry treating apparatus based on a scheme of putting the laundry into the drum.

The laundry treating apparatus may include a cabinet forming an appearance of the laundry treating apparatus, a tub accommodated in the cabinet, a drum that is rotatably mounted inside the tub and into which the laundry is put, and a detergent feeder that supplies detergent into the drum.

When the drum is rotated by a motor while wash water is supplied to the laundry accommodated in the drum, dirt on the laundry may be removed by friction with the drum and the wash water.

The detergent feeder has a detergent supply function to enhance a washing effect. In this connection, the detergent refers to a substance that enhances the washing effect, such as fabric detergent, fabric softener, fabric bleach, and the like. Detergent in a powder form and detergent in a liquid form may be used.

Related document KR 10-2020-0091245 discloses a detergent feeder constituting a laundry treating apparatus. The laundry treating apparatus according to the prior art document includes a tub installed inside a main body, a drum installed inside the tub, and a detergent feeder that supplies laundry detergent to the tub, and is installed so as to be retracted into and extended from a front surface of the main body. In addition, the detergent feeder includes a housing forming an appearance of the detergent feeder, a storage container that is extended in a front and rear direction of the main body, stores the laundry detergent, and is mounted in the housing, and a laundry detergent pump that is installed on one side of the storage container, sucks the laundry detergent stored in the storage container, and discharges the laundry detergent downward of the housing.

In the detergent feeder disclosed in the prior are document, the storage container in which the detergent is stored, and the housing that accommodates the storage container therein and is retracted into and extended from the main body are separate components that may be separated from each other.

SUMMARY

Embodiments of the present disclosure are intended to provide a laundry treating apparatus that may effectively improve convenience of a user by securing a detergent storage capacity of a storage.

In addition, embodiments of the present disclosure are intended to provide a detergent feeder including a storage that may store different detergents separately from each other.

In addition, embodiments of the present disclosure are intended to provide a laundry treating apparatus in which a cover for shielding a detergent storage space may be easily removed.

In addition, embodiments of the present disclosure are intended to provide a laundry treating apparatus that may increase convenience of a user by sensing an amount of detergent stored in a storage.

In addition, embodiments of the present disclosure are intended to provide a laundry treating apparatus that may effectively improve ease of manufacture and use of a storage.

To solve the above-described problems, one embodiment of the present disclosure may provide a detergent storage space for storing detergent directly in a storage frame that forms an appearance of a storage without storing the detergent using a separate detergent reservoir in the storage in a detergent feeder. A capacity of the stored detergent may be increased by removing the detergent reservoir.

The storage frame may include a partition frame to store different detergents in a separate manner, and the bulkhead frame may divide the detergent storage space into a plurality of storage spaces.

A cover may be included to shield an open surface of the detergent storage space in order to prevent the stored detergent from leaking to the outside, and the cover may be directly coupled to the storage frame.

According to an aspect of the present disclosure, provided is a laundry treating apparatus including a cabinet having a detergent opening defined a front surface thereof, a tub located inside the cabinet and storing wash water therein, a drum rotatably disposed inside the tub and storing laundry therein, and a storage for storing detergent to be supplied to the tub therein, wherein the storage is retracted into or extended out of the cabinet through the detergent opening, wherein the storage includes a storage frame having a detergent storage space defined therein for storing the detergent therein, wherein a top surface of the storage frame is opened such that the detergent storage space is opened, a cover seat portion formed on the storage frame and formed along a perimeter of the detergent storage space, and a cover detachably coupled to the cover seat portion to shield at least a portion of an open top surface of the detergent storage space.

In one implementation, the storage frame may include a frame bottom surface, a frame outer wall extending upward from edges of the frame bottom surface to define the detergent storage space, and a frame partition wall extending upward from the frame bottom surface to divide the detergent storage space, and the cover seat portion may be formed on top of the frame outer wall and the frame partition wall.

In one implementation, the frame outer wall may include a front outer wall positioned on a front surface of the storage frame, and a rear outer wall positioned on a rear surface of the storage frame, and the frame partition wall may include an auxiliary storage partition wall spaced apart from the frame outer wall and surrounding a portion of the detergent storage space, a front partition wall for connecting the front outer wall and the auxiliary storage partition wall to each other, and a rear partition wall for connecting the rear outer wall and the auxiliary storage partition wall to each other.

In one implementation, the frame outer wall may further include a first side outer wall and a second side outer wall for connecting the front outer wall and the rear outer wall to each other.

The detergent storage space may include a first storage space defined between the first side outer wall and the frame partition wall, a second storage space defined between the second side outer wall and the frame partition wall, and a third storage space surrounded by the auxiliary storage partition wall, and the cover may include a first cover for shielding an open top surface of the first storage space, and a second cover for shielding an open top surface of the second storage space.

In one implementation, the cover seat portion may include a first seat portion extending along a perimeter of the first storage space and coupled to the first cover, and a second seat portion extending along a perimeter of the second storage space and coupled to the second cover, and the first seat portion and the second seat portion may be individually disposed on the frame partition wall.

In one implementation, the first seat portion and the second seat portion may individually extend continuously along the frame partition wall and the frame outer wall to form different closed cross-sections.

In one implementation, the laundry treating apparatus may further include a fastening elastic portion positioned inside the cabinet and above the storage frame and protruding toward the storage frame, and a fastening protrusion disposed in the storage frame and protruding upward, wherein the fastening protrusion is in contact with the fastening elastic portion during the extension and the retraction of the storage, and the fastening protrusion may be disposed on the rear partition wall and positioned between the first seat portion and the second seat portion.

In one implementation, the cover may include a cover base disposed in parallel with the frame bottom surface to shield the open top surface of the detergent storage space, and a cover coupling portion extending along a perimeter of the cover base and including a coupling insertion portion, wherein the cover seat portion is inserted into the coupling insertion portion.

In one implementation, the storage frame may include a front outer wall on a front surface thereof, a rear outer wall on a rear surface thereof, and a first side outer wall and a second side outer wall respectively on both side surfaces thereof, and the cover coupling portion may further include a cover handle extending in a direction away from the frame partition wall from a portion thereof coupled to the first side outer wall or the second side outer wall.

In one implementation, each of the first side outer wall and the second side outer wall may include a coupling rib protruding laterally to support the cover coupling portion, and the cover handle may be disposed to be spaced apart from the coupling rib.

In one implementation, the laundry treating apparatus may further include a fixing assembly disposed inside the cabinet, wherein the fixing assembly is disposed to face an open top surface of the storage retracted into the detergent opening, wherein the fixing assembly includes a stopper protruding toward the storage frame, and the storage may further include an extension limiting portion protruding toward the fixing assembly and contacting the stopper during the extension of the storage to limit an extension distance of the storage.

In one implementation, the cover handle may be formed rearwardly of the extension limiting portion.

In one implementation, the cover may further include a detergent cap coupled to the cover base to shield a detergent hole defined in the cover base, and the detergent cap may be located forwardly of the extension limiting portion.

In one implementation, the cover seat portion may protrude toward the cover coupling portion, and the cover coupling portion may include a coupling guide portion having a guide surface inclined with respect to a protruding direction of the cover seat portion to induce coupling between the cover seat portion and the cover coupling portion, and a coupling pressure portion formed to face the guide surface to press the cover seat portion.

In one implementation, the cover seat portion may include a pressing protrusion protruding toward the coupling pressure portion.

In one implementation, the storage may further include a detergent valve penetrating the rear outer wall, wherein the detergent valve is constructed to regulate discharge of detergent stored in the first storage space or the second storage space.

In one implementation, the laundry treating apparatus may further include a detecting sensor disposed on the rear outer wall, wherein the detecting sensor detects an amount of detergent stored in the first storage space or the second storage space through a sensor electrode, and an exposed surface exposed to the detergent storage space may be formed on at least a portion of a front surface of the detecting sensor where the sensor electrode is disposed.

In one implementation, the rear outer wall may further include a sensor rib protruding from the rear outer wall toward the detergent storage space, and extending to cross the exposed surface of the detecting sensor to support the detecting sensor.

In one implementation, at least a portion of the sensor rib may be positioned upwardly and laterally of the sensor electrode to prevent detergent on the rear outer wall from flowing to the sensor electrode.

Embodiments of the present disclosure may provide the laundry treating apparatus that may effectively improve the convenience of the user by securing the detergent storage capacity of the storage.

In addition, embodiments of the present disclosure may provide the detergent feeder including the storage that may store the different detergents separately from each other.

In addition, embodiments of the present disclosure may provide the laundry treating apparatus in which the cover for shielding the detergent storage space may be easily removed.

In addition, embodiments of the present disclosure may provide the laundry treating apparatus that may increase the convenience of the user by sensing the amount of the detergent stored in the storage.

In addition, embodiments of the present disclosure may provide the laundry treating apparatus that may effectively improve the ease of manufacture and use of the storage.

DETAILED DESCRIPTION

Figure 1:
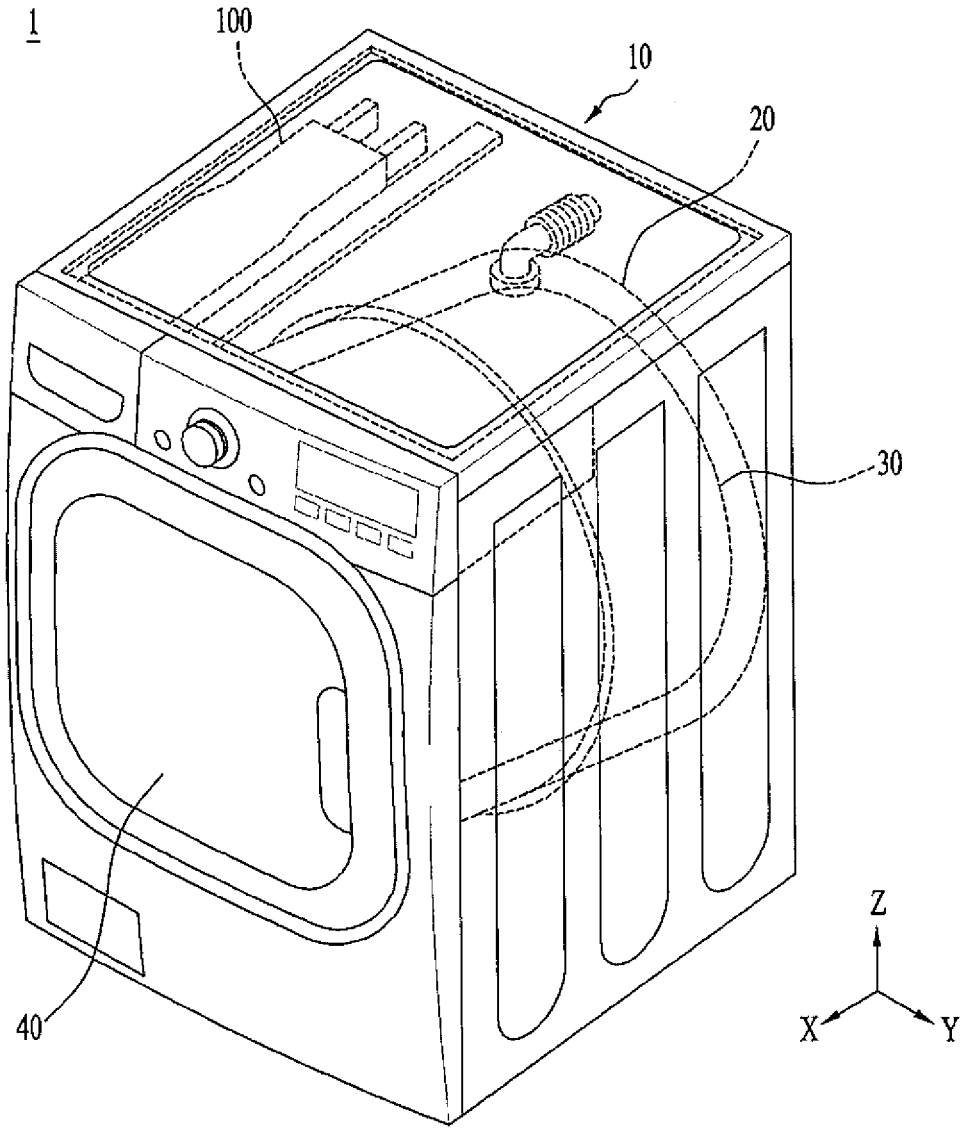
FIG. 1 is a perspective view showing a laundry treating apparatus according to an embodiment of the present disclosure.

Hereinafter, an embodiment of the present disclosure will be described in detail with reference to the accompanying drawings such that a person having ordinary knowledge in the technical field to which the present disclosure belongs may easily implement the embodiment.

However, the present disclosure is able to be implemented in various different forms and is not limited to the embodiment described herein. In addition, in order to clearly describe the present disclosure, components irrelevant to the description are omitted in the drawings. Further, similar reference numerals are assigned to similar components throughout the specification.

Duplicate descriptions of the same components are omitted herein.

In addition, it will be understood that when a component is referred to as being 'connected to' or 'coupled to' another component herein, it may be directly connected to or coupled to the other component, or one or more intervening components may be present. On the other hand, it will be understood that when a component is referred to as being 'directly connected to' or 'directly coupled to' another component herein, there are no other intervening components.

The terminology used in the detailed description is for the purpose of describing the embodiments of the present disclosure only and is not intended to be limiting of the present disclosure.

As used herein, the singular forms 'a' and 'an' are intended to include the plural forms as well, unless the context clearly indicates otherwise.

It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, in this specification, the term 'and/or' includes a combination of a plurality of listed items or any of the plurality of listed items. In the present specification, 'A or B' may include 'A', 'B', or 'both A and B'.

Figure 2:
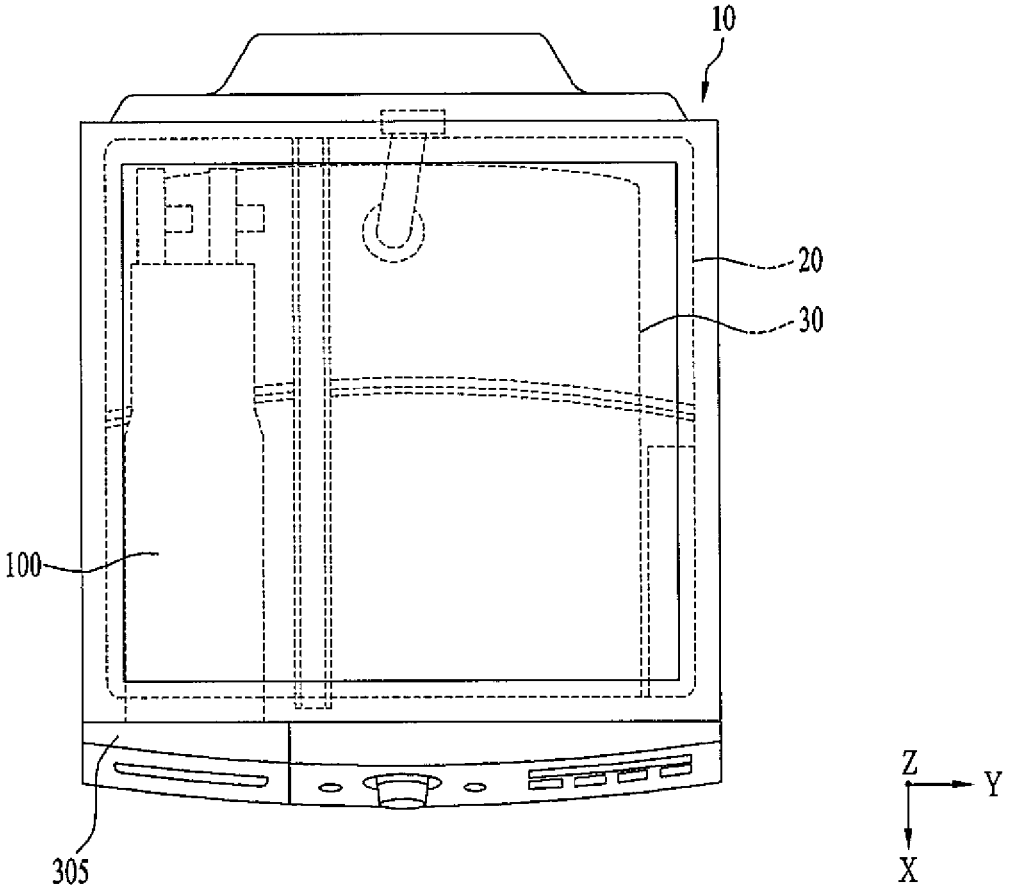
FIG. 2 is a top view of a laundry treating apparatus.
Figure 3:
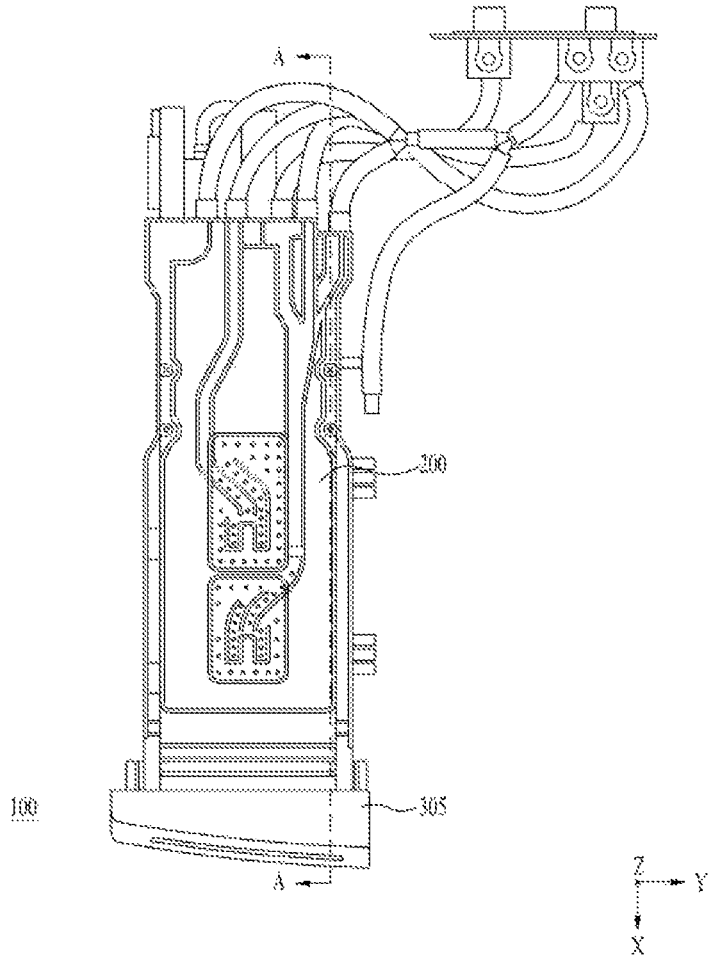
FIG. 3 is a top view showing a detergent feeder of a laundry treating apparatus according to an embodiment of the present disclosure.

FIG. 1 is a perspective view showing a laundry treating apparatus 1 according to an embodiment of the present disclosure, and FIG. 2 is a view of the laundry treating apparatus 1 viewed from above. FIG. 3 is a top view showing a detergent feeder 100 of the laundry treating apparatus 1 according to an embodiment of the present disclosure.

Referring to FIGS. 1 to 3, the laundry treating apparatus 1 according to an embodiment of the present disclosure includes a cabinet 10 having a detergent opening 15 defined in a front surface thereof, a tub 20 installed inside the cabinet 10, a drum 30 rotatably installed inside the tub 20, and the detergent feeder 100 installed inside the detergent opening 15.

The laundry treating apparatus 1 may include a washing machine in which a cloth is inserted into a washing tub to be subjected to washing, rinsing, dehydration, and the like, a dryer in which a wet cloth is inserted to be subjected to drying, or the like.

The laundry treating apparatus 1 may be divided into a top load-type apparatus and a front load-type apparatus. FIG. 1 shows the laundry treating apparatus 1 of the front load-type, which is only for convenience of description, and is also applicable to the top load-type washing machines because the present disclosure does not apply only to the front load-type washing machines.

As shown in FIG. 1, the laundry treating apparatus 1 may include the cabinet 10 that forms an appearance thereof, and a manipulation unit that receives various control commands from a user and has a display (not shown) for displaying information on an operating state. The laundry treating apparatus 1 may include a door 40 pivotably installed on a front surface of the cabinet 10 to allow the laundry to be put into and pulled out of the laundry treating apparatus 1.

The cabinet 10, which forms the appearance of the laundry treating apparatus 1, may have a space defined therein in which various components constituting the laundry treating apparatus 1 may be accommodated. The drum 30 for accommodating therein the laundry input through the door 40 may be installed inside the cabinet 10.

Specifically, inside the cabinet 10, the tub 20 for containing wash water therein, and the drum 30 rotatably disposed in the tub 20 and accommodating the laundry therein may be disposed. A balancer for compensating for eccentricity occurred by rotation may be installed on one side of the drum 30.

The above-described manipulation unit may include various keys for operating the operating state of the laundry treating apparatus 1 and the display for displaying the operating state of the laundry treating apparatus 1. The door 40 may contain a transparent member such as tempered glass such that an interior of the cabinet 10 or the drum 30 may be visually identified.

In one example, in one embodiment of the present disclosure, the laundry treating apparatus 1 may have the detergent opening 15 on the front surface thereof, and a detergent feeder 100 may be positioned at the interior of the cabinet 10 reachable through the detergent opening 15.

A location of the detergent opening 15 may vary. FIG. 1 shows that the detergent opening 15 is defined parallel to the manipulation unit in a lateral direction Y.

The detergent feeder 100 may be installed through the detergent opening 15 that may be defined on one side of an upper portion of the cabinet 10. The detergent feeder 100 may include a detergent storage 300 that may store the detergent therein.

FIG. 3 is a top view of the detergent feeder 100. A fixing assembly disposed inside the cabinet 10, and disposed to face one surface extending in the front and rear direction X of the storage 300 retracted into the detergent opening 15 may be included. The fixing assembly may serve as a guide for guiding a movement of the storage 300 while the storage 300 is retracted into or extended out of the cabinet 10.

The dispenser assembly 200 may serve as the fixing assembly. In this case, the fixing assembly may be understood to mean the dispenser assembly 200.

The detergent feeder 100 serves to automatically supply the detergent stored in the storage 300 into the drum 30 in a washing operation. The detergent means a substance that may enhance a washing effect of the laundry, and may include liquid fiber detergent and liquid fabric softener.

Figure 4:
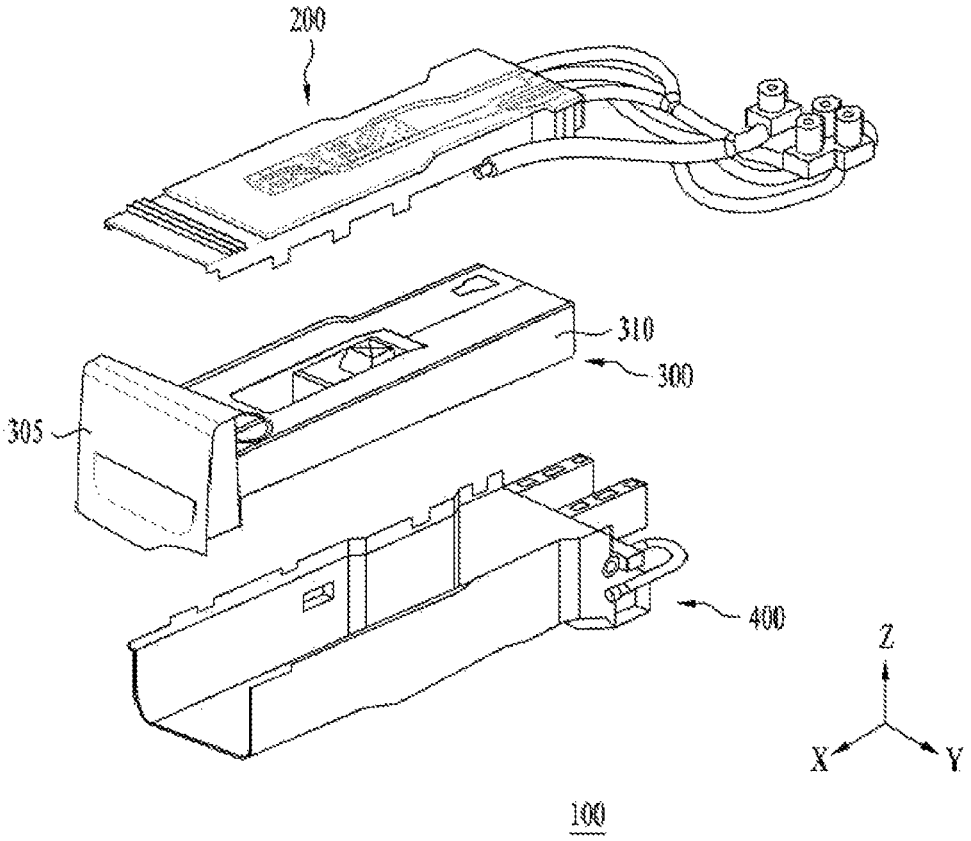
FIG. 4 is an exploded view of a detergent feeder in an embodiment of the present disclosure.

FIG. 4 shows the detergent feeder 100 being disassembled. The detergent feeder 100 may include the dispenser assembly 200, the storage 300, and a supply casing 400 from above as shown in FIG. 4.

The storage 300 is where the detergent is stored, is able to be retracted into the detergent opening 15 along the front and rear direction X, and is able to include a front handle 305 and a storage frame 310 for storing the detergent therein.

In the present disclosure, definition of forward and rearward directions may be achieved based on the detergent opening 15. For example, a direction from the detergent opening 15 to an exterior of the cabinet 10 may be understood as the forward direction, and a direction from the detergent opening 15 to the interior of the cabinet 10 may be understood as the rearward direction. That is, even when the door 40 and the detergent opening 15 are disposed on and defined in different surfaces in the cabinet 10, the forward and rearward directions may be defined based on the detergent opening 15.

Figure 5:
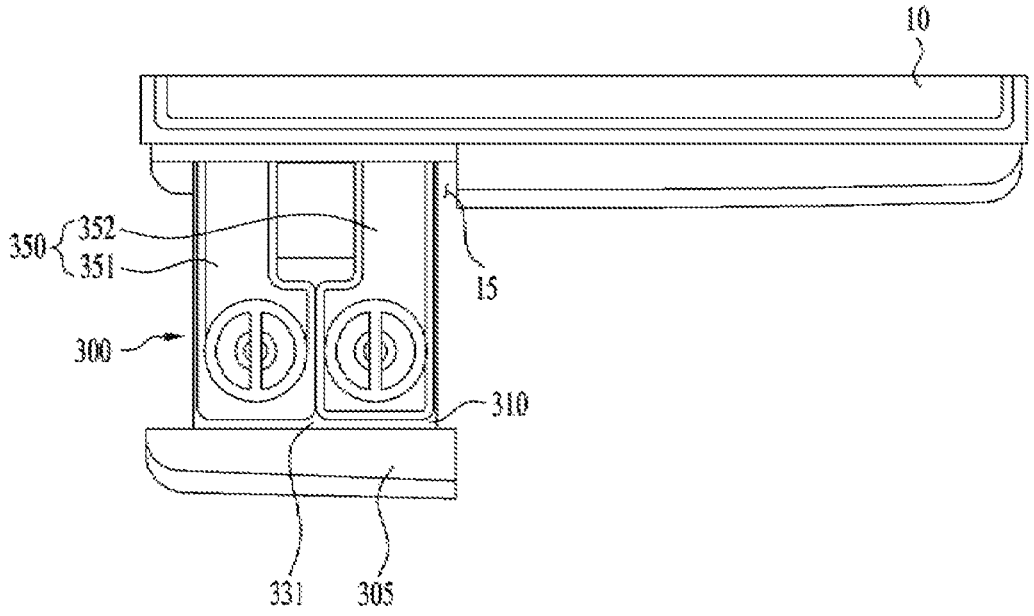
FIG. 5 is a view showing a state in which a storage is extended from a laundry treating apparatus in an embodiment of the present disclosure.

In one example, FIG. 5 shows the storage 300 extended from the detergent opening 15, viewed from the exterior of the cabinet 10.

When the user grips and pulls the handle 305 disposed on the front surface of the storage 300, the storage 300 in the state of being retracted into the detergent opening 15 slides forward from a state of being stacked with the dispenser assembly 200 and the supply casing 400 to be extended to be exposed to the outside of the cabinet 10 or to the outside of the detergent opening 15. Similarly, when the user pushes the handle 305 rearward, the storage 300 may be inserted into the detergent opening 15 while being slid.

Figure 6:
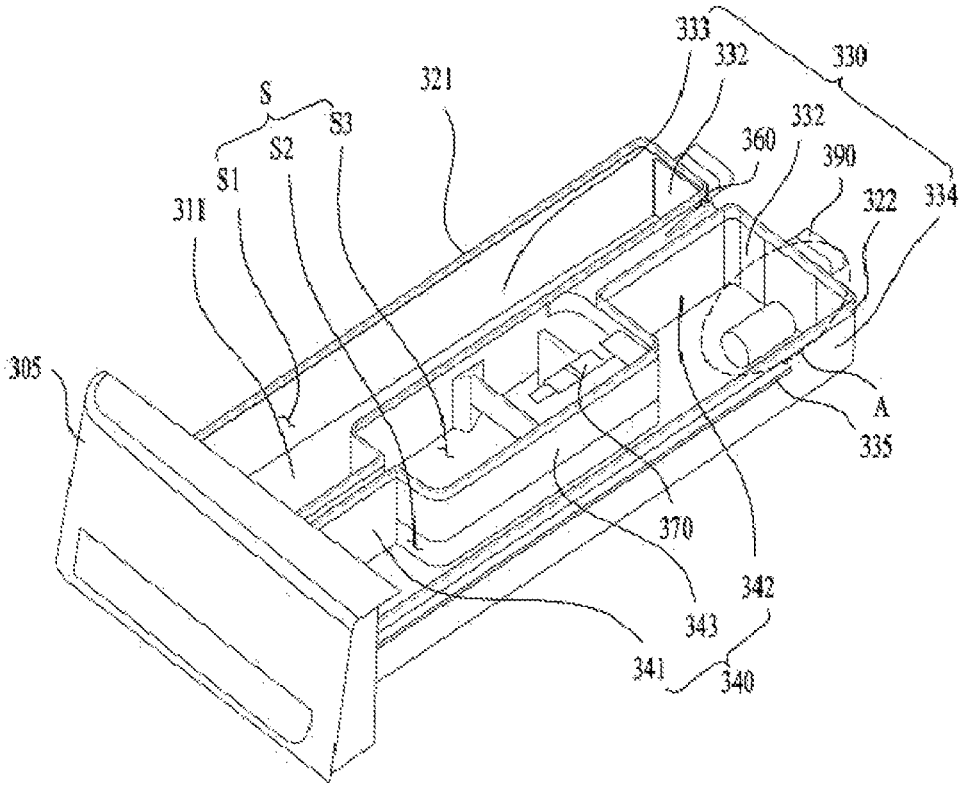
FIG. 6 is a perspective view of a storage according to an embodiment of the present disclosure.
Figure 7:
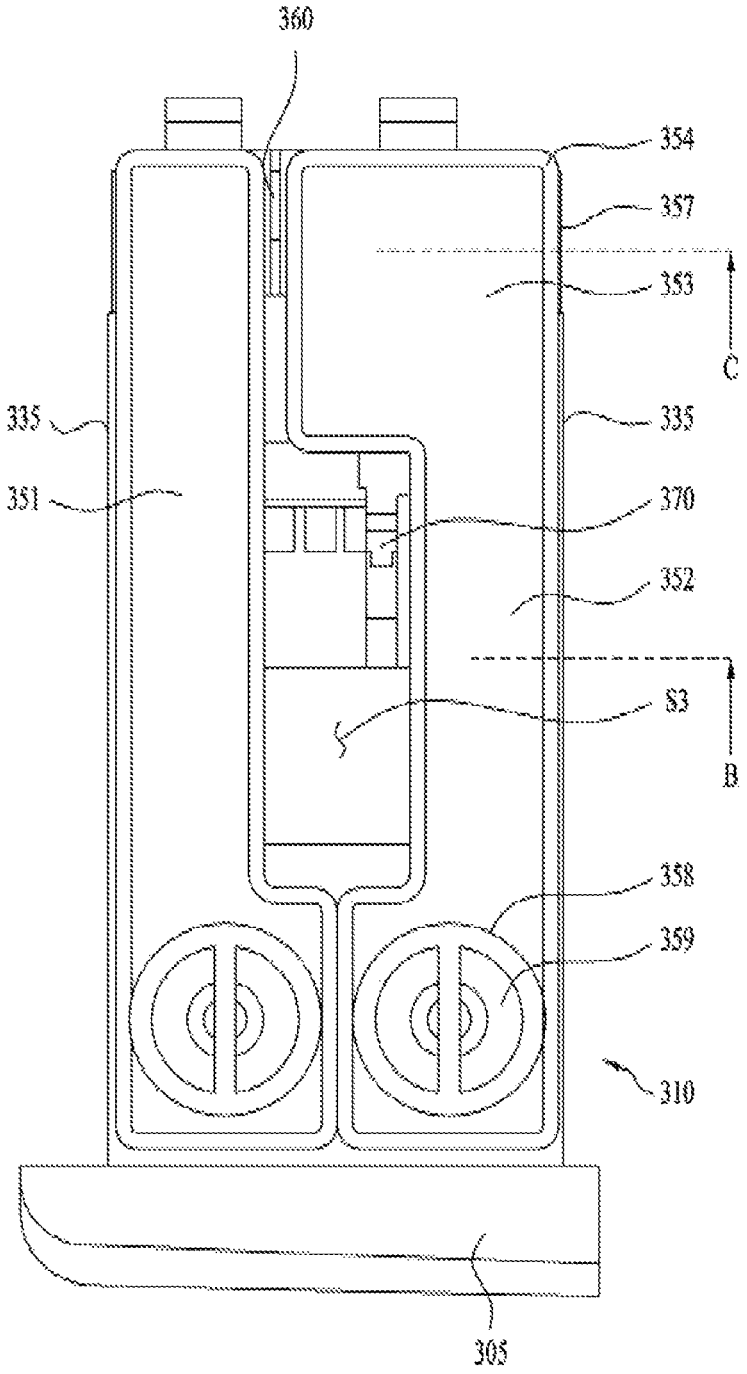
FIG. 7 is a top view of a storage according to an embodiment of the present disclosure.

FIGS. 6 and 7 show a storage of a laundry treating apparatus according to an embodiment of the present disclosure. FIG. 6 shows a storage in a state in which a cover is removed therefrom. FIG. 7 shows a storage in a state in which a cover is coupled thereto.

The laundry treating apparatus 1 according to an embodiment of the present disclosure may include the cabinet 10 having the detergent opening 15 defined in the front surface thereof, the tub 20 disposed inside the cabinet 10, and storing the wash water therein, the drum 30 rotatably disposed inside the tub 20, and storing the laundry therein, and the storage 300 that stores the detergent supplied to the tub 20 therein, and is retracted into or extended from the cabinet 10 through the detergent opening 15. The storage 300 may have the storage frame 310 that has a detergent storage space S in which the detergent is stored defined therein, and has an open top surface such that the detergent storage space S is opened, a cover seat portion 320 disposed on the storage frame 310, and disposed on a perimeter of the detergent storage space S, and a cover 350 that is detachably coupled to the cover seat portion 320 to shield at least a portion of the open top surface of the detergent storage space S.

The detergent opening 15 may be defined to communicate the interior and the exterior of the cabinet with each other. In the present specification, the detergent opening 15 is described as meaning a portion penetrating one side of the cabinet 10. However, the detergent opening 15 may mean an entire space occupied by the storage 300 when the storage 300 is extended.

The storage 300 may be retracted into the cabinet 10 or may be extended from the cabinet 10 through the detergent opening 15. When the storage 300 is extended out of the cabinet 10, it is possible to prevent the storage 300 from being extended by a distance greater than a preset distance using an extension limiting portion 370. The storage 300 may be completely removed from the cabinet 10 by manipulating the extension limiting portion 370.

The handle 305 may be disposed at the front surface of the storage 300 so as to be gripped by the user when extending the storage 300 out of the cabinet 10. The handle 305 may have a handle groove that is recessed so as to be gripped by a finger. The user may extend the storage 300 to the outside of the cabinet 10 by supporting his or her finger in the handle groove.

The user may easily extend the storage 300 using the handle 305 and put the detergent into the extended storage 300. In addition, the user may easily clean or repair the storage 300 by removing the storage 300 from the cabinet 10.

The storage 300 includes the storage frame 310 that stores the detergent needed for the laundry washing therein. The detergent storage space S may be defined by the storage frame 310, and the detergent may be stored inside the detergent storage space S. A separate storage container may not be seated in the detergent storage space S, and the detergent may be in direct contact with the detergent storage space S. That is, the detergent may be stored while being in direct contact with one surface of the storage frame 310.

The detergent stored in the storage frame 310 may be supplied to the tub 20 through a detergent valve 380 that is coupled through one side of the storage frame 310. A pump may be coupled to the detergent valve 380 to discharge the detergent as much as a preset capacity. An amount of detergent discharged may be set to change based on various conditions such as a weight of the laundry being stored, an amount of wash water, the washing course, and the like. Pumps of various uses and types may be applied to the pump.

The detergent stored in the detergent storage space S may be supplied to tub 20 by a certain amount in a plurality of laundry washing processes. However, the present disclosure may not be limited thereto, and all of the detergent stored in the detergent storage space S may be supplied toward the tub 20 in one laundry washing process. This may also be changed based on the various conditions as described above.

The detergent storage space S defined by the storage frame 310 may have the open top surface. The cover 350 may be detachably coupled to shield the open top surface of the detergent storage space S. The cover 350 may be coupled to an upper end of the storage frame 310.

The storage frame 310 has the cover seat portion 320 along the perimeter of the detergent storage space S. The formation of the cover seat portion 320 along the perimeter of the detergent storage space S includes extension along a perimeter of the upper end of the storage frame 310. The cover seat portion 320 may be constructed to protrude upward, but may not be limited thereto, and may be manufactured in various shapes to which the cover 350 may be coupled.

The storage frame 310 may be integrally formed without including the separate detergent storage container as described above, so that the different detergents may be stored separately.

The storage frame 310 may include a frame bottom surface 311 that forms a bottom surface, a frame outer wall 330 that extends upward from edges of the frame bottom surface to define the detergent storage space S, and a frame partition wall 340 that extends upward from the frame bottom surface 311 to divide the detergent storage space.

That is, the detergent storage space S may be defined by the frame outer wall 330 and the frame partition wall 340 extending upward from the frame bottom surface 311, and the detergent storage space S may be divided to store the different detergents. The frame partition wall 340 may connect outer walls of the frame outer wall 330 while crossing the detergent storage space S.

In addition, the frame bottom surface 311 may be formed to trap all of the detergent stored thereon without having a through-hole defined therein. However, the through-hole may be defined on one side of the frame bottom surface 311. The frame partition wall 340 may be formed to surround a perimeter of the through-hole. The detergent may not be stored in the portion in which the through-hole is defined, and may be stored in the tub 20 immediately after being input.

The cover seat portion 320 may be disposed on top of the frame outer wall 330 and the frame partition wall 340. The cover seat portion 320 may extend upward while being disposed on top of the frame outer wall 330 and the frame partition wall 340, and may extend along the perimeter of the detergent storage space S. Accordingly, the cover 350 may be detachably coupled to the cover seat portion 320 to shield an open top surface of at least a portion of the detergent storage space S.

The frame outer wall 330 may include a front outer wall 331 positioned on a front surface of the storage frame. The front outer wall 331 may be formed as a component separate from the handle 305 formed on the front surface of the storage 300 and coupled to the handle 305. However, the present disclosure may not be limited thereto, and the handle 305 may form a front surface of the frame outer wall 330. That is, the handle 305 and the front outer wall 331 may be integrally formed.

The frame outer wall 330 may include a rear outer wall 332 positioned at a rear surface of the storage frame. The rear outer wall 332 may face away from and may be formed parallel to the front outer wall 331. The rear outer wall 332 may extend upward from the frame bottom surface 311.

The frame outer wall 330 may include a first side outer wall 333 and a second side outer wall 334 connecting the front outer wall 331 and the rear outer wall 332 to each other. The first side outer wall 333 and the second side outer wall 334 may extend upward from the frame bottom surface 311 in parallel with each other.

The front outer wall 331, the rear outer wall 332, the first side outer wall 333, and the second side outer wall 334 may be integrally formed with the frame bottom surface 311 to define the detergent storage space S having the open top surface. That is, the detergent storage space S may be defined by the frame bottom surface 311 and the frame outer wall 330.

The frame partition wall 340 may include an auxiliary storage partition wall 343 spaced apart from the frame outer wall 330, and surrounding a portion of the detergent storage space. The space surrounded by the secondary storage partition wall 343 may be defined as a third storage space S3. The through-hole may be defined in a portion of the frame bottom surface 311 forming a bottom surface of the third storage space as described above.

The frame partition wall 340 may include a front partition wall 341 that connects the front outer wall 331 and the auxiliary storage partition wall 343 with each other, and a rear partition wall 342 that connects the rear outer wall 332 and the auxiliary storage partition wall 343 with each other. The front partition wall 341, the auxiliary storage partition wall 343, and the rear partition wall 342 are extended in the front and rear direction to divide the detergent storage space S.

The detergent storage space S may be divided into three spaces by the front partition wall 341, the auxiliary storage partition wall 343, and the rear partition wall 342. The detergent storage space S may be divided into a first storage space S1 defined between the first side outer wall 333 and the frame partition wall 340, a second storage space S2 defined between the second side outer wall 334 and the frame partition wall 340, and the third storage space S3 surrounded by the auxiliary storage partition wall 343.

Detergents stored in the first storage space S1 and the second storage space S2 may not be supplied to the tub 20 immediately after being input, but may remain in the first storage space S1 and the second storage space S2 and then be supplied to the tub 20 by the preset capacity in the plurality of laundry washing processes through the detergent valve 380 penetrating the rear outer wall 332.

The different detergents may be stored in the first storage space S1 and the second storage space S2. A liquid detergent may be stored in the first storage space S1 and the second storage space S2. The liquid detergent may include a laundry detergent or a fabric softener used in a general laundry process. The detergents stored in the first storage space S1 and the second storage space S2 may be introduced into the tub 20 through the detergent valve 380 as needed, so that the detergents may preferably be liquid detergents.

As an example of the use of the present disclosure, the laundry detergent may be stored in the first storage space S1 and the fabric softener may be stored in the second storage space S2, and the laundry detergent may be supplied to the tub 20 from the first storage space S1 in a washing process and the fabric softener may be supplied from the second storage space S2 to the tub 20 in a final rinsing process.

Because the detergents necessary for the washing and rinsing processes may be stored in the first storage space S1 and the second storage space S2, the hassle of having to put the detergent every time the user uses the laundry treating apparatus 1 may be eliminated. That is, there is an effect of increasing convenience of the user in using the laundry treating apparatus 1.

In addition, because the detergent storage container disposed separately from the storage frame 310 may not be used, there is an effect of storing more detergent in the space used to be occupied by the detergent storage container. That is, a detergent injection cycle of the user becomes longer, so that the convenience of the user may be increased.

In one example, the cover 350 may include a first cover 351 and a second cover 352 that shield open top surfaces of the first storage space S1 and the second storage space S2, respectively. When the first storage space S1 or the second storage space S2 is used while the top surface thereof is opened, the stored detergent may leak to the outside by vibration of the laundry treating apparatus 1 or during the process of retraction and extension of the storage 300.

The first cover 351 and the second cover 352 may shield the open top surfaces of the first storage space S1 and the second storage space S2 to define the closed first storage space S1 and second storage space S2, respectively. Therefore, it is possible to prevent the detergent from leaking to the outside in an operation process of the laundry treating apparatus 1 or in the process of injecting the detergent into the first storage space S1 or the second storage space S2 and retracting and extending the storage 300 into and out of the cabinet 10.

The first cover 351 and the second cover 352 may prevent the storage 300 and the laundry treating apparatus 1 from being contaminated by the detergent leaking to the outside as described above, and may save the user's trouble of cleaning the contaminated portion. That is, there is an effect of increasing usability and convenience of the user.

The auxiliary storage partition wall 343 may define the third storage space S3 to be separated from the first storage space S1 and the second storage space S2. A top surface of the third storage space S3 may not be shielded by the cover 350. That is, the top surface of the third storage space S3 may always be opened.

In the third storage space S3, a detergent different from those in the first storage space S1 and the second storage space S2 may be stored. The through-hole may be defined in the frame bottom surface 311 forming the bottom surface of the third storage space S3. The detergent stored in the third storage space S3 may be supplied to the tub 20 through the through-hole, unlike those in the first storage space S1 and the second storage space S2.

In the third storage space S3, detergent in a form that is not frequently used may be input. For example, when it is necessary to use detergent, which is less frequently used than the general laundry detergent or the fabric softener, such as bleach, neutral detergent, or the like, the user may directly extend the storage 300 out of the cabinet 10 and put the detergent by a required capacity into the third storage space S3. However, the present disclosure may not be limited thereto. The detergent input to the third storage space S3 may be the same as the detergent stored in the first storage space S1 or the second storage space S2, and may correspond to the detergent in the powder form. That is, not only the liquid detergent, but also various types of detergent may be put into the third storage space S3 and used in the washing process.

A water supply valve may be disposed above the third storage space S3 such that the detergent injected into the third storage space S3 may receive water from above. The water supply may be performed by the dispenser assembly 200. The detergent accommodated in the third storage space S3 together with the wash water discharged from the water supply valve may be discharged toward the tub 20.

As described above, as the third storage space S3 is defined, the various detergents, separately from the detergent stored in the first storage space S1 or the second storage space S2, may be used for the laundry washing based on needs of the user, so that the convenience of the user is increased. In addition, because the top surface of the third storage space S3 is opened, the user may easily inject the detergent without the process of removing the cover independently.

The cover seat portion 320 may include a first seat portion 321 to which the first cover is coupled and a second seat portion 322 to which the second cover is coupled. The first cover 351 and the second cover 352 may be separated from each other to individually shield the open top surfaces of the first storage space S1 and the second storage space S2, respectively.

The first seat portion 321 may extend along a perimeter of the first storage space S1. The extension along the perimeter of the first storage space S1 may mean extension along perimeters of upper ends of the first side outer wall 333, the front outer wall 331, the rear outer wall 332, and the frame partition wall 340 defining the first storage space S1.

The first seat portion 321 may protrude upward from a portion of the storage frame 310. A closed cross-section may be formed when the first seat portion 321 is viewed from the top. The formation of the closed cross-section may mean that a starting point and an end point of the extension of the first seat portion 321 along the perimeter of the first storage space S1 are the same.

For example, when the first seat portion 321 extends starting from a connection point between the first side outer wall 333 and the front outer wall 331, the first seat portion may extend along the front outer wall 331 from the starting point, then extend along the frame partition wall 340 from a connection point of the front outer wall 331 and the frame partition wall 340, then extend again along the rear outer wall 332 from a connection portion between the frame partition wall 340 and the rear outer wall 332, and then finally extend along the first side outer wall 333 to return to the starting point.

The first cover may be coupled to the first seat portion 321 extended as described above, so that the open top surface of the first storage space S1 may be shielded. That is, the detergent stored in the first storage space S1 may be safely stored.

With the same scheme as described above for the first seat portion 321, a second seat portion 322 extending along the perimeter of the second storage space and to which the second cover 352 is coupled may be formed. The second seat portion may extend along the second side outer wall 334, the rear outer wall 332, the frame partition wall 340, and the front outer wall 331 to form a closed cross-section in the same manner as the first seat portion 321.

The first cover 351 and the second cover 352 should be respectively formed on the front partition wall 341 and the rear partition wall 342 so as to be coupled to the first seat portion 321 and the second seat portion 322 to shield the first storage space S1 and the second storage space S2, respectively. In order for the first cover 351 and the second cover 352 to be respectively coupled to the first seat portion 321 and the second seat portion 322, the first seat portion 321 and the second seat portion 322 should be spaced apart from each other. Accordingly, the first seat portion and the second seat portion may be respectively formed on the front partition wall 341 and the rear partition wall 342.

As an embodiment, the cover seat portion 320 having two portions protruding to be spaced apart from each other in a width direction of the storage 300 may be disposed on the front partition wall 341, and one of the portions may constitute the first seat portion 321 and the other may constitute the second seat portion 322. When the portion constituting the first seat portion 321 is present on a left side when the storage 300 is viewed from the front, the first seat portion 321 may extend to the rear partition wall 342 along a portion on a left side of the point connected to the auxiliary storage partition wall 343.

As described above for the first seat portion 321 and the second seat portion 322 formed on the front partition wall 341, the first seat portion 321 and the second seat portion 322 may be formed on the rear partition wall 342 in the same scheme.

Figure 8:
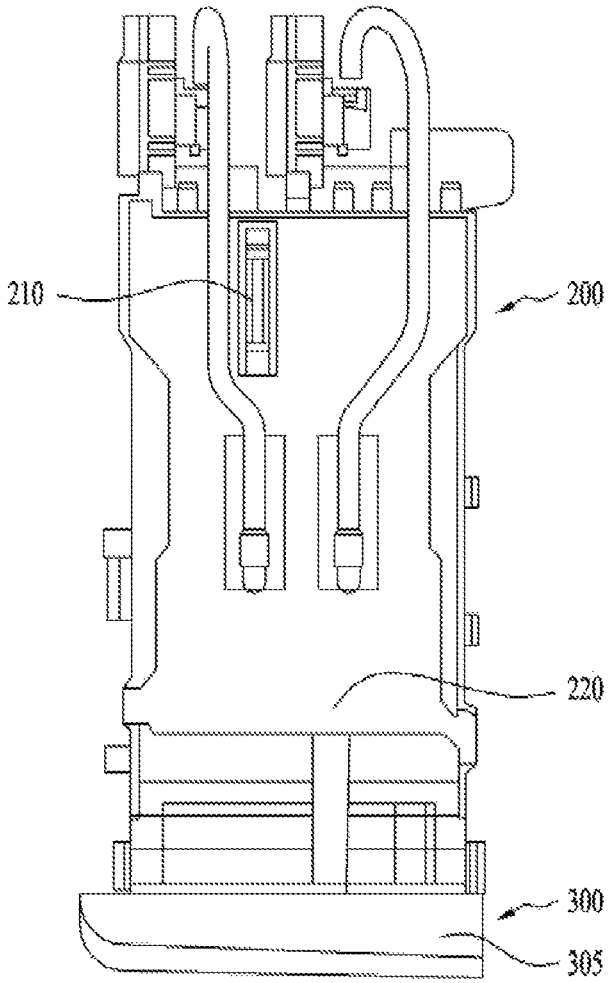
FIG. 8 is a top view of a fixing assembly according to an embodiment of the present disclosure.

FIG. 8 shows a fixing assembly according to an embodiment of the present disclosure. In the present specification, the dispenser assembly may be understood to be the same component as the fixing assembly.

Referring to FIGS. 6 and 8, an embodiment of the present disclosure may further include a fastening elastic portion 210 disposed in the cabinet 10 and positioned above the storage frame 310, and protruding toward the storage frame 310, and a fastening protrusion 360 disposed in the storage frame 310 and protruding upward, and in contact with the fastening elastic portion 210 in the extension process of the storage 300.

The fastening elastic portion 210 may be formed in the dispenser assembly 200 disposed on top of the storage frame 310. The dispenser assembly 200 may serve as the fixing assembly.

The fastening elastic portion 210 may be made of a deformable material or may be formed to be movable within a limited position range. The fastening elastic portion 210 may be constructed to be in contact with the fastening protrusion 360 disposed in the storage frame 310 in the retraction and extension process of the storage 300.

The fastening elastic portion 210 may be deformed or moved a predetermined distance by being pressed by the fastening protrusion 360. When the fastening elastic portion 210 is deformed by the fastening protrusion 360, an elastic force may be generated, and the fastening protrusion 360 may be pressed in a specific direction by the elastic force.

In the process of retracting the storage 300 into the cabinet 10, when the fastening protrusion 360 comes into contact with the fastening elastic portion 210, and the fastening elastic portion 210 is deformed to generate the elastic force, the user gripping the handle 305 of the storage 300 may sense the corresponding elastic force. When the retraction of the storage 300 is completed and the storage 300 is retracted by a maximum retractable distance, the elastic force may disappear. In this case, the user may sense that the storage 300 is disposed at an appropriate location.

When the storage 300 is not sufficiently retracted, the detergent may not be smoothly supplied during the operation process of the laundry treating apparatus 1. Because the user may sense whether the storage 300 is properly retracted by the fastening protrusion 360 and the fastening elastic portion 210, it is easy to couple the storage 300 to a correct position.

A protruding shape of the fastening elastic portion 210 may be varied as needed. For example, the fastening protrusion 360 and the fastening elastic portion 210 may have a shape in which a center thereof protrudes so as to have a gentle inclination from a front portion and a rear portion thereof.

The fastening elastic portion 210 may be made of a material that has elasticity and is able to be deformed and restored, and may have greater elasticity than the fastening protrusion 360. In addition, the fastening elastic portion 210 may have greater elasticity than a material of the fixing assembly.

The fastening elastic portion 210 may be disposed such that at least a portion thereof, for example, a portion including an end protruding downward, overlaps the fastening protrusion 360 along the front and rear direction or the retraction direction of the storage 300.

The storage 300 may be extended such that the fastening protrusion 360 is located forwardly of the fastening elastic portion 210, and the fastening protrusion 360 may be moved rearward toward the fastening elastic portion 210 during the retraction process. The fastening protrusion 360 may be moved rearward to overlap the fastening elastic portion 210 in a vertical direction.

In the retraction process of the storage 300, the fastening protrusion 360 may be moved rearward while passing the fastening elastic portion 210. That is, the fastening elastic portion 210 may be positioned to overlap the fastening protrusion 360 in the vertical direction, and be pressed and deformed by the fastening protrusion 360. The fastening elastic portion 210 pressed by the fastening protrusion 360 may be deformed to lower a protruding height thereof. Accordingly, the fastening protrusion 360 may be moved rearward past the fastening elastic portion 210.

When storage 300 is fully retracted into the detergent opening 15, the fastening protrusion 360 is located rearwardly of the fastening elastic portion 210 past the fastening elastic portion 210. When the fastening protrusion 360 passes the fastening elastic portion 210 after causing the deformation of the fastening elastic portion 210, the fastening elastic portion 210 may be elastically restored.

The user may extend the storage 300 from the detergent opening 15 using the handle 305, and put the detergent into the storage 300. The storage 300 in which the detergent is stored may slide and is retracted into the detergent opening 15 again. At this time, the user may be aware of the retraction situation of the storage 300 through the contact relationship between the fastening protrusion 360 and the fastening elastic portion 210.

For example, in the process of gripping the handle 305 and retracting the storage 300 rearward, the user may recognize the contact between the fastening protrusion 360 and the fastening elastic portion 210, and may receive a predetermined pressure. At the same time when a maximum protrusion point of the fastening protrusion 360 passes a maximum protrusion point of the fastening elastic portion 210, the pressure delivered to the user may be reduced, and the user may recognize a degree of retraction of the storage 300.

In addition, the deformed fastening elastic portion 210 may press the fastening protrusion 360 rearward while being restored. As such, when the fastening protrusion 360 is pressed by the fastening elastic portion 210, the storage 300 may naturally move rearward.

As described above, during the retraction process of the storage 300, the user may feel that a reaction force in a direction opposite to the retraction direction increases, and may recognize that a force in the same direction as the retraction direction is applied after a certain moment. That is, because the storage 300 may be retracted by the fastening elastic portion 210 even when the user applies a small force after the specific moment, there is an effect of increasing the user convenience.

In one example, at least a portion of the fastening elastic portion 210 may be detachably coupled to the fixing assembly. Specifically, the fastening elastic portion 210 may be manufactured separately from the fixing assembly, and at least a portion thereof may be coupled to the fixing assembly. In this connection, the fastening elastic portion 210 may be detachably coupled to the fixing assembly.

The fastening elastic portion 210 may correspond to an elastic body that is deformed by being pressed by the fastening protrusion 360 and restored. It may be advantageous that the fastening elastic portion 210 is easier to be deformed than the material of the fixing assembly and has excellent elasticity. In one embodiment of the present disclosure, such fastening elastic portion 210 is manufactured separately from the fixing assembly, so that the fastening elastic portion 210 may be manufactured using a material different from that of the fixing assembly with high rigidity.

In addition, the manufacturing of the fixing assembly may include a heat treatment process. In this case, the material constituting the fixing assembly may decrease in the elasticity and increase in the rigidity after the heat treatment. When molding the fastening elastic portion 210 together with the fixing assembly, the fastening elastic portion 210 may also have decrease in the elasticity by the heat treatment process.

That is, one embodiment of the present disclosure manufactures the fastening elastic portion 210 separately from the fixing assembly and detachably couple the fastening elastic portion 210 to the fixing assembly, which is advantageous because it is possible to avoid a change in properties of the material resulted from a series of molding processes included in the manufacturing of the fixing assembly.

The fastening protrusion 360 may be disposed on the rear partition wall 342. Specifically, the fastening protrusion 360 may be positioned between the first seat portion 321 and the second seat portion 322. Because an additional structure is not required to form the fastening protrusion 360, and the space of the storage frame 310 is able to be efficiently used, there is an effect of increasing the capacity of stored detergent.

Figure 9:
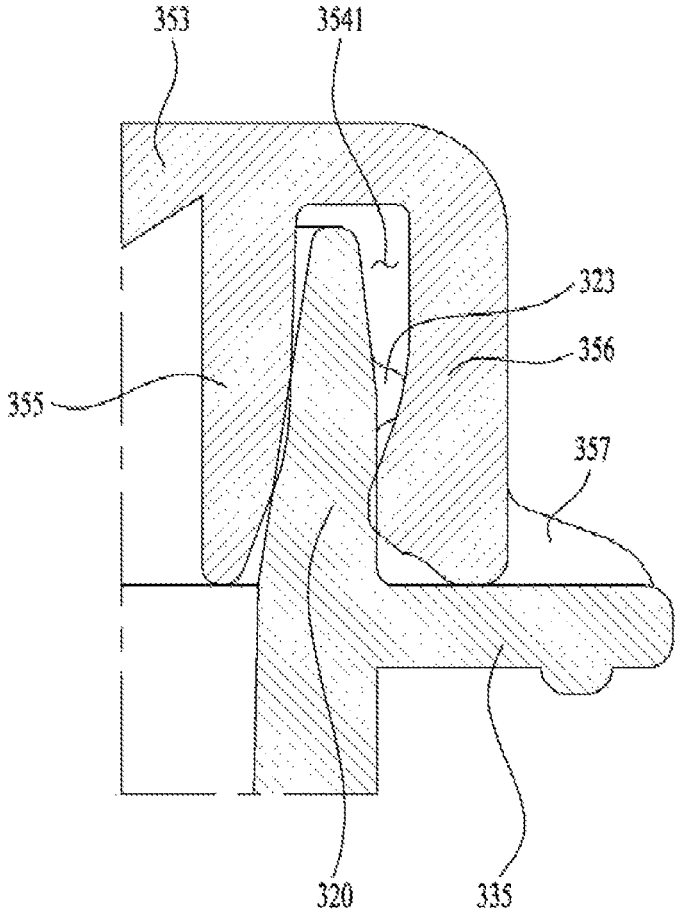
FIG. 9 is a cross-sectional view of a cover coupling portion according to an embodiment of the present disclosure.

FIG. 9 shows a cover and a storage frame to which the cover is coupled, according to an embodiment of the present disclosure. A cross-section in a direction B of FIG. 7 is shown.

Referring to FIGS. 7 and 9, the cover 350 of the laundry treating apparatus according to an embodiment of the present disclosure may include a cover base 353 disposed in parallel with the frame bottom surface 311 to shield the open top surface of the detergent storage space, and a cover coupling portion 354 extending along a perimeter of the cover base 353 and including a coupling insertion portion 3541 into which the cover seat portion 320 is inserted.

Preferably, the cover base 353 shields the open top surfaces of the first storage space S1 and the second storage space S2. Preferably, the cover base has a larger area than a surface formed by the cover seat portion 320 in order to shield the open top surface.

A cover coupling portion 354 formed to be coupled to the cover seat portion 320 may be disposed along the perimeter of the cover base 353. The cover coupling portion 354 may have the coupling insertion portion 3541 that is recessed upwardly. With a scheme in which the cover seat portion 320 is inserted into the coupling insertion portion 3541, the cover 350 may shield the open top surface of the detergent storage space S.

The coupling insertion portion 3541 may be formed in a shape corresponding to the cover seat portion 320. The coupling insertion portion 3541 may be in contact with the cover seat portion 320 on several surfaces to increase a contact frictional force, and may increase a bonding strength of the cover 350 to prevent a situation in which the cover 350 is unintentionally removed and the detergent stored in the first storage space S1 or the second storage space S2 leaks.

Referring to FIG. 6, the storage frame 310 may have the front outer wall 331 disposed on the front surface thereof, the rear outer wall 332 disposed on the rear surface thereof, and the first side outer wall 333 and the second side outer wall 334 respectively disposed on the both side surfaces thereof.

The cover coupling portion 354 may further include a cover handle 357 extending in a direction away from the frame partition wall 340 from a portion coupled to the first side outer wall 333 or the second side outer wall 334.

The user may easily remove the cover 350 by gripping the cover handle 357 when removing the cover 350 from the storage frame 310. Because the cover handle 357 protrudes from the side surface of the storage frame 310 and is exposed to the outside, the user may grip the cover handle 357 without being disturbed by other structures.

Each of the first side outer wall 333 and the second side outer wall may include a coupling rib 335 protruding laterally to support the cover coupling portion 354. In addition, the cover handle 357 may be disposed to be spaced apart from the coupling rib 335.

The coupling rib 335 may extend from each of the first side outer wall 333 and the second side outer wall 334 in the direction away from the frame partition wall 340. The coupling rib 335 may have a length smaller than a length in the front and rear direction of the first side outer wall 333 or the second side outer wall 334.

The coupling rib 335 may extend laterally from one point of the first side outer wall 333 or the second side outer wall 334 where the cover seat portion 320 is formed so as to be in contact with the cover coupling portion 354. When the cover seat portion 320 is inserted into the coupling insertion portion 3541 of the cover coupling portion 354, a bottom of the cover coupling portion 354 may be supported by being in contact with the coupling rib 335.

When the cover coupling portion 354 is supported on the coupling rib 335, it is possible to reduce deformation resulted from bending applied to the cover seat portion 320 in the process of detaching the cover 350. In addition, because a contact area with the storage frame 310 is increased when the cover 350 is coupled, the cover 350 may be coupled more stably. That is, the situation in which the cover 350 is unintentionally removed from the storage frame 310 and the detergent leaks may be prevented.

When the coupling rib 335 is extended to be in contact with the cover handle 357, a space for the user to grip the cover handle 357 may be reduced. Therefore, even when the coupling rib 335 extends along the first side outer wall 333 or the second side outer wall 334, the coupling rib 335 may extend apart from the cover handle 357.

In order for the coupling rib 335 and the cover handle 357 to be spaced apart from each other, the cover 350 may be manufactured such that the coupling rib 335 is not formed on a portion where the cover handle 357 is disposed when the cover 350 is coupled.

Preferably, the cover handle 357 may be formed to protrude from the cover coupling portion 354 so as to be located at a rear portion of the first side outer wall 333 or the second side outer wall 334, and the coupling rib 335 may extend from a front portion of the first side outer wall 333 or the second side outer wall 334 to a point right ahead of a point at which the cover handle 357 is disposed.

When the cover handle 357 and the coupling rib 335 are formed to be spaced apart from each other as described above, a coupling force of the cover 350 may be strengthened by the coupling rib 335, and stability of the storage frame 310 may be increased, and at the same time, the user may easily remove the cover 350 from the storage frame 310 by gripping the cover handle 357.

In one example, the laundry treating apparatus 1 according to an embodiment of the present disclosure may further include the fixing assembly including a stopper 220 disposed inside the cabinet 10, disposed to face the open top surface of the storage 300 retracted into the detergent opening 15, and protruding toward the storage frame.

Figure 13:
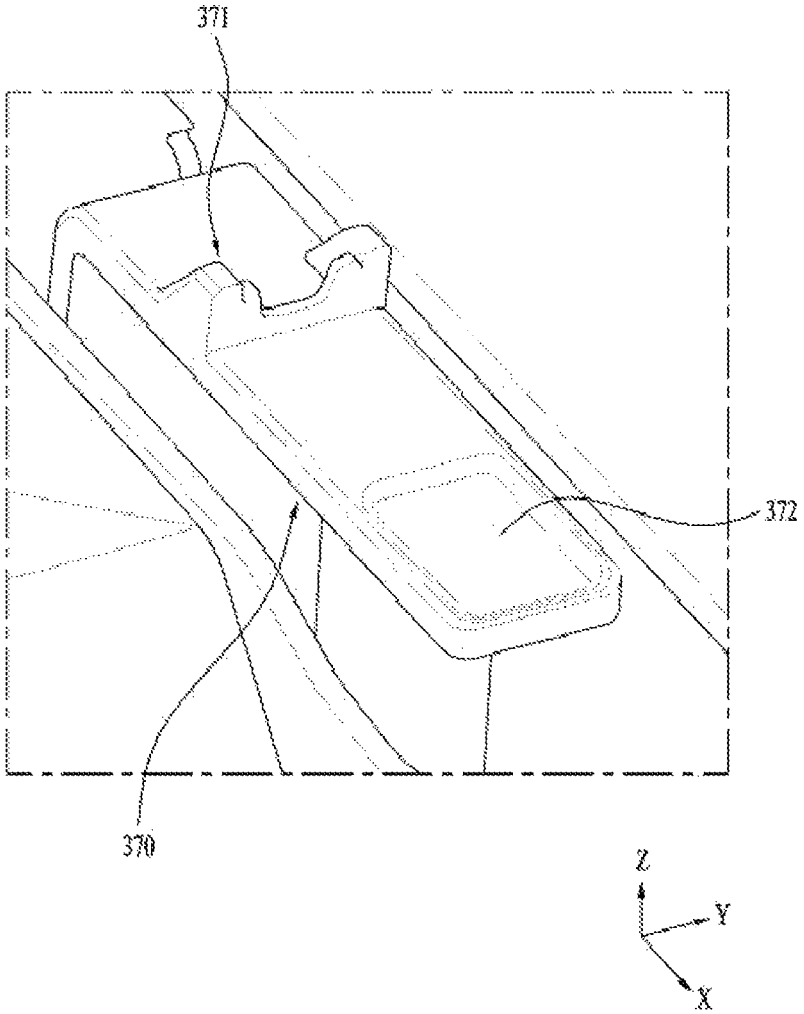
FIG. 13 is a perspective view of an extension limiting portion according to an embodiment of the present disclosure.
Figure 14:
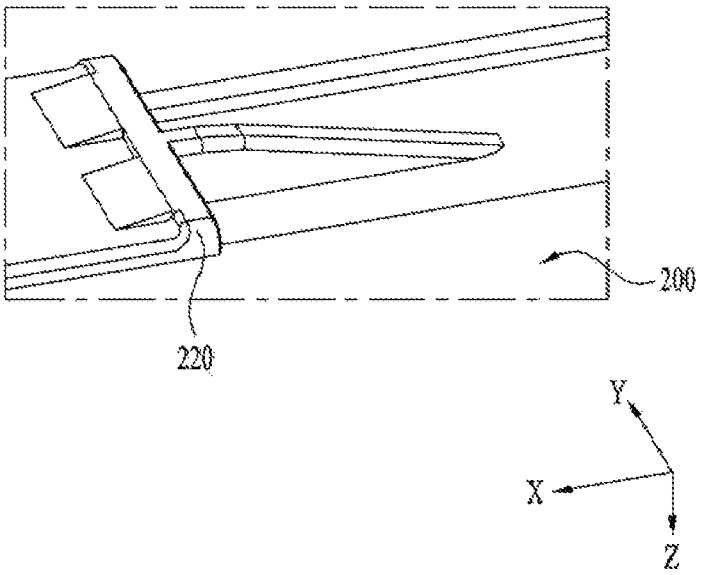
FIG. 14 is a perspective view of a stopper according to an embodiment of the present disclosure.
Figure 15:
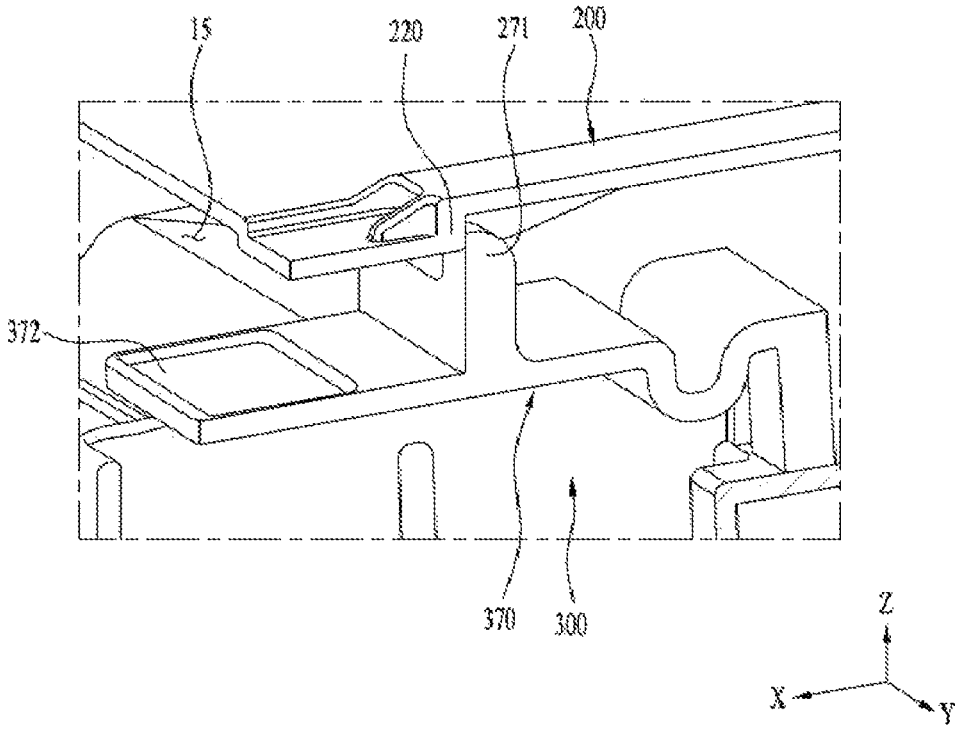
FIG. 15 shows a state in which an extension limiting portion and a stopper are coupled to each other, according to an embodiment of the present disclosure.

FIG. 13 shows an extension limiting portion disposed on a frame partition wall of the present disclosure. FIG. 14 shows a stopper disposed in a fixing assembly facing a storage. FIG. 15 shows a state in which a stopper and an extension limiting portion are coupled to each other.

Referring to FIGS. 13 to 15, an embodiment of the present disclosure may further include the extension limiting portion 370 in the storage 300, and the extension limiting portion 370 may be exposed to the outside of the detergent opening 15 in the state in which the storage 300 is extended by a set extension distance.

The stopper 220 may be disposed in the dispenser assembly 200 and protrude downward toward the storage 300. The stopper 220 may be disposed on the bottom surface of the dispenser assembly 200, and may be disposed so as not to overlap with the fastening elastic portion 210 in the front and rear direction X. That is, the stopper 220 may be disposed to be spaced apart from the fastening elastic portion 210 in the lateral direction Y.

The extension limiting portion 370 may be disposed in the storage 300 and may protrude upward toward the dispenser assembly 200. The extension limiting portion 370 may be disposed so as not to overlap the fastening protrusion 360 in the front and rear direction X. For example, the fastening protrusion 360 may be disposed on the rear partition wall 342 of the storage frame 310, and the extension limiting portion 370 may be disposed on one side of the auxiliary storage partition wall 343 that does not overlap the rear partition wall 342.

The stopper 220 may be disposed in parallel with the extension limiting portion 370 along the front and rear direction X to overlap each other. Accordingly, in the process of extension of the storage 300, the stopper 220 overlaps the extension limiting portion 370, so that the movement of the storage 300 may be restricted.

In addition, in the state in which the storage 300 is retracted into the detergent opening 15, the stopper 220 may be disposed to be spaced forwardly apart from a fastening portion 371, and a spacing distance between the stopper 220 and the fastening portion 371 may correspond to the preset extension distance.

Therefore, in the case in which the user extends the storage 300 by gripping the handle 305 of the storage 300 from the state in which the storage 300 is retracted into the detergent opening 15, when the fastening portion 371 of the extension limiting portion 370 comes into contact with the stopper 220 of the dispenser assembly 200, the extension of the storage 300 may be limited, and the user may store the detergent using the storage 300 extended by the set extension distance.

Specifically, the extension limiting portion 370 may have a rear end fixed to the storage 300 and a front end that forms a free end. Accordingly, the extension limiting portion 370 may be elastically deformed, and the front end thereof may be moved in the vertical direction Z around the rear end, which may be accomplished by the user pressing the front end of the extension limiting portion 370.

The fastening portion 371 may be formed to protrude upward between the front and rear ends of the extension limiting portion 370. Therefore, when the fastening portion 371 is in contact with the stopper 220 and the extension of the storage 300 is limited, the front end of the extension limiting portion 370 located forwardly of the fastening portion 371 may be exposed to the outside of the detergent opening 15, and it may become easy for the user to press the front end of the extension limiting portion 370.

The user may space the fastening portion 371 downwardly apart from the stopper 220 by pressing the front end of the extension limiting portion 370 exposed forwardly of the detergent opening 15, and may completely extend and separate the storage 300 from the detergent opening 15 while releasing the extension restriction based on the set extension distance.

The storage 300 may further include the extension limiting portion 370 protruding toward the fixing assembly and in contact with the stopper 220 during the extension process of the storage 300 to limit the extension distance of the storage 300.

The fixing assembly may correspond to the dispenser assembly 200. The stopper 220 may be constructed to correspond to the extension limiting portion 370. The stopper 220 may be formed such that the extension limiting portion 370 is caught by the stopper 220 during the extension process of the storage 300 to limit the extension of the storage 300.

The extension limiting portion 370 may be pressed downward to fully extend the storage 300 out of the cabinet 10. When the extension limiting portion 370 is pressed downward, the storage 300 may escape from the extension limit by the stopper 220 and be removed from the cabinet 10.

The stopper 220 and the extension limiting portion 370 may prevent an accident in which the storage 300 is unintentionally detached and dropped while the user supplies the detergent or manipulates the storage 300.

The cover handle 357 may be formed rearwardly of the extension limiting portion 370. The cover handle 357 is formed on the cover coupling portion 354. When the cover handle 357 is formed to be easily gripped in the state in which a portion of the storage 300 is extended, unlike an intention of the user, the cover may be removed from the storage frame 310 and the detergent may leak.

When being extended by the predetermined distance by the extension limiting portion 370, the storage 300 may not be completely removed from the cabinet 10 without additional manipulation of the extension limiting portion 370. That is, a portion of the storage 300 is accommodated inside the cabinet 10 in a general use environment.

When the cover handle 357 is formed rearwardly of the extension limiting portion 370, it may be difficult for the user to access the cover handle 357 without manipulating the extension limiting portion 370. Therefore, it is possible to prevent a situation in which the cover handle 357 is arbitrarily manipulated to remove the cover 350 and the detergent leaks.

The cover 350 may further include a detergent cap 359 disposed to shield the detergent hole 358 defined in the cover base 353, and the detergent cap 359 may be located forwardly of the extension limiting portion 370.

Referring to FIG. 7, the user may inject the detergent through the detergent hole 358 without removing the cover 350 when supplying the detergent to the detergent storage space shielded by the cover 350. When the detergent hole 358 is kept open, the detergent may leak, so that the detergent hole 358 may be shielded by the detergent cap 359. In addition, in order to inject the detergent by extending the storage 300 by only a distance required for the detergent injection without completely extending the storage 300, the detergent hole 358 and the detergent cap 359 may be located forwardly of the extension limiting portion 370.

As an example of supplying the detergent to the storage 300, the user may extend the storage 300 by the predetermined distance limited by the extension limiting portion 370, then inject the detergent by opening the detergent cap 359 exposed to the user, and then recouple the detergent cap 359 and re-retract the storage 300.

In the use with the same process as above, the user may significantly reduce a frequency of removing the cover 350 from the storage frame 310. Accordingly, a frequency of the user's manipulation of the cover handle 357 is also reduced, so that the detergent may be easily injected into the detergent storage space S while the cover handle 357 is disposed rearwardly of the extension limiting portion 370 to prevent the detergent from leaking as the cover 350 is unintentionally removed.

In one example, referring to FIG. 9, the cover seat portion 320 of the laundry treating apparatus 1 according to an embodiment of the present disclosure may protrude toward the cover coupling portion 354, and the cover coupling portion 354 may include a coupling guide portion 355 constructed to induce coupling between the cover seat portion 320 and the cover coupling portion 354 by having a guide surface inclined with respect to a protruding direction of the cover seat portion 320, and a coupling pressure portion 356 that is formed to face the guide surface and pressurizes the cover seat portion 320.

That is, in the cover coupling portion 354, the coupling pressure portion 356 and the coupling guide portion 355 may be formed outwardly of and inwardly of the coupling insertion portion 3541, respectively. The present disclosure may not be limited thereto, and the coupling guide portion 355 and the coupling pressure portion 356 may be formed outwardly of and inwardly of the coupling insertion portion 3541, respectively.

The coupling guide portion 355 may have the guide surface that is inclined with respect to the protruding direction of the cover seat portion 320. The coupling of the cover 350 to the cover seat portion 320 may be guided along the guide surface.

A recession direction of the coupling insertion portion 3541 may also be inclined with the cover seat portion 320 like the guide surface. The cover coupling portion 354 may be made of a deformable material to cause the deformation and generate the elastic force in the process in which the cover seat portion 320 is inserted. In addition, the coupling force of the cover coupling portion 354 to the cover seat portion 320 may be improved by the elastic force.

The coupling pressure portion 356 may be formed to face the guide surface. The coupling pressure portion 356 may be formed in a shape in which a surface thereof facing the cover seat portion 320 protrudes toward the cover seat portion 320. When being coupled to the cover seat portion 320, the protruding portion may press the cover seat portion 320 to improve a coupling force.

The coupling pressure portion 356 may also be made of a deformable material like the coupling guide portion 355 to improve a strength of the coupling of the cover 350 using an elastic force resulted from the deformation when being coupled to the cover seat portion 320.

One of the coupling pressure portion 356 and the coupling guide portion 355 may be constructed to be supported by the above-described coupling rib 335. When one of the coupling pressure portion 356 and the coupling guide portion 355 is supported by the coupling rib 335, the strength of the coupling between the cover 350 and the storage frame 310 may be further improved, and the situation in which the cover 350 is unintentionally removed and the detergent leaks may be prevented.

The cover seat portion 320 may further include a pressing protrusion 323 protruding toward the coupling pressure portion 356. The pressing protrusion 323 may contact the coupling pressure portion 356 to deform the coupling pressure portion 356 in the state in which the cover 350 is coupled. An elastic force may be generated by the deformation, and thus the coupling force between the cover 350 and the cover seat portion 320 may be improved.

FIG. 9 shows that outlines of the coupling guide portion 355, the coupling pressure portion 356, and the cover seat portion 320 overlap each other. This shows shapes before the coupling. When the cover 350 and the cover seat portion 320 are actually coupled to each other, the overlapping portions of the coupling guide portion 355 and the coupling pressure portion 356 may be deformed to come into contact with the cover seat portion 320. In addition, the cover handle 357 shown in FIG. 9 is shown as being in contact with the coupling rib 335. However, this is only because the cover handle 357 located at the rear is shown because FIG. 9 is a view of a cut surface. The coupling rib 335 may be formed only up to a point in front of the cover handle 357, so that the cover handle 357 and the coupling rib 335 may be spaced apart from each other.

In addition, in the process of coupling the cover 350 to the cover seat portion 320, the cover coupling portion 354 may come into contact with the pressing protrusion 323, and the pressing protrusion 323 may be inserted into the coupling insertion portion 3541. In a process in which the cover seat portion 320 and the cover coupling portion 354 are being coupled to each other rather than in the state in which the cover seat portion 320 and the cover coupling portion 354 are fully coupled to each other, the coupling pressure portion 356 may be maximally deformed by the pressing protrusion 323. Therefore, when the cover seat portion 320 and the cover coupling portion 354 are fully coupled to each other, a reaction force felt by the user is reduced. Thus, the user may perceive whether the cover coupling portion 354 and the cover seat portion 320 are completely coupled to each other.

That is, the pressing protrusion 323 makes it possible to recognize whether the cover seat portion 320 and the cover coupling portion 354 are fastened to each other by the decrease in the pressure felt by the user. Therefore, it is possible to prevent the detergent stored in the detergent storage space S from leaking because the cover 350 is not sufficiently coupled to the detergent storage space S.

Figure 10:
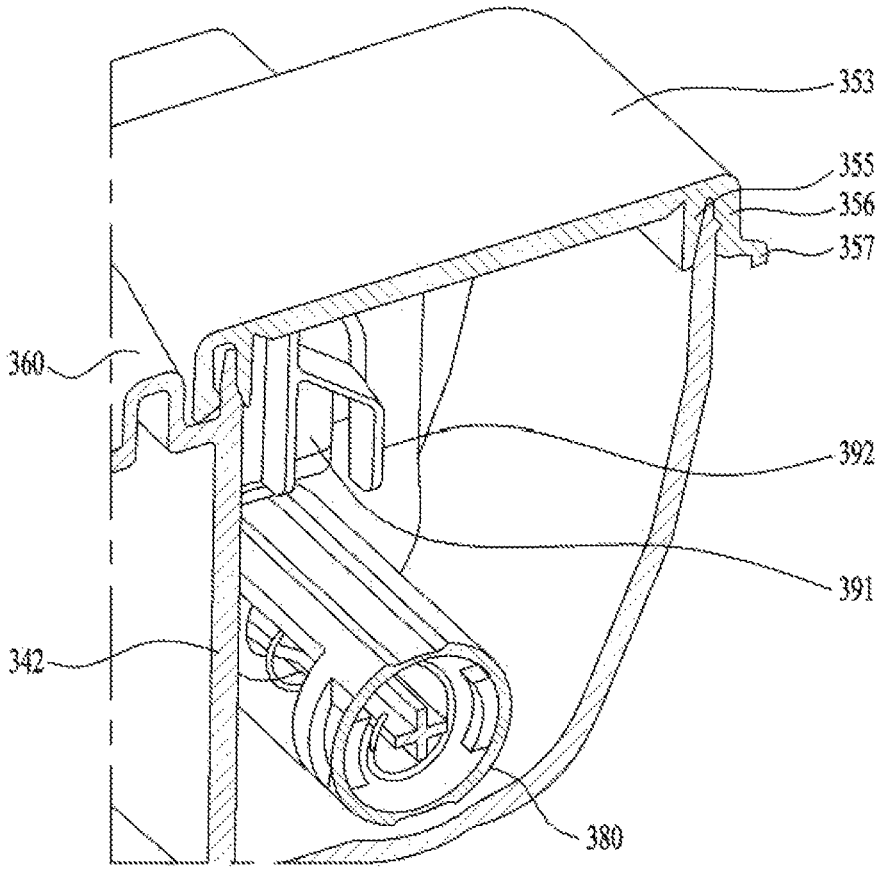
FIG. 10 is a cross-sectional perspective view of a rear portion of a storage frame according to an embodiment of the present disclosure.
Figure 11:
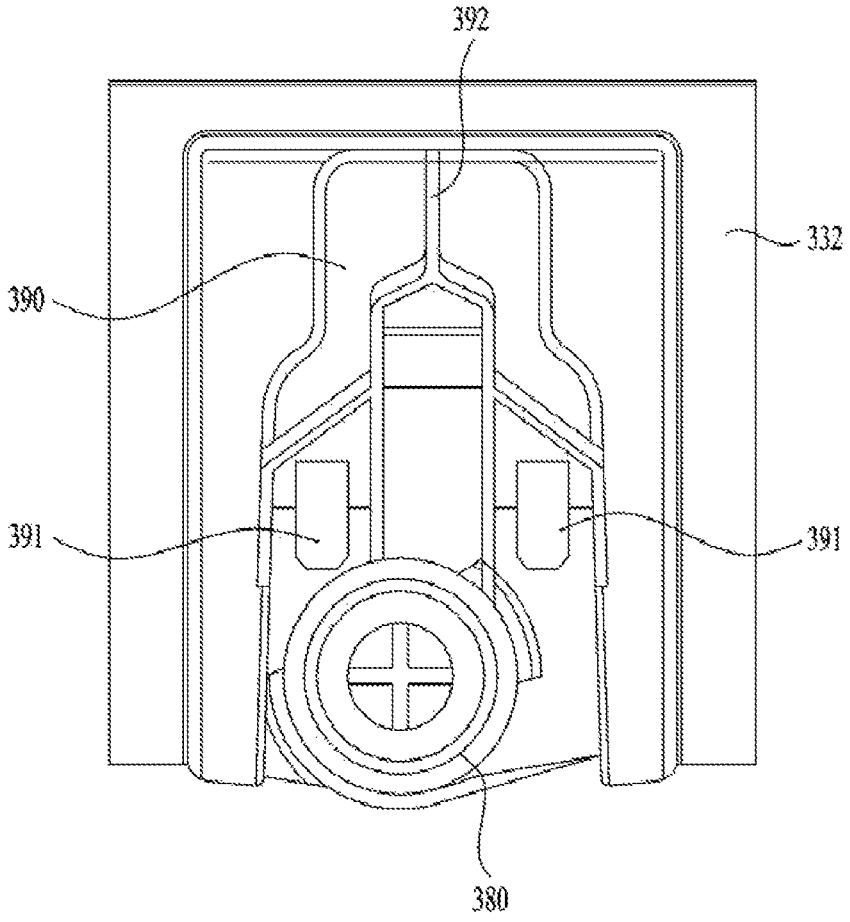
FIG. 11 is a perspective view of a detecting sensor according to an embodiment of the present disclosure.
Figure 12:
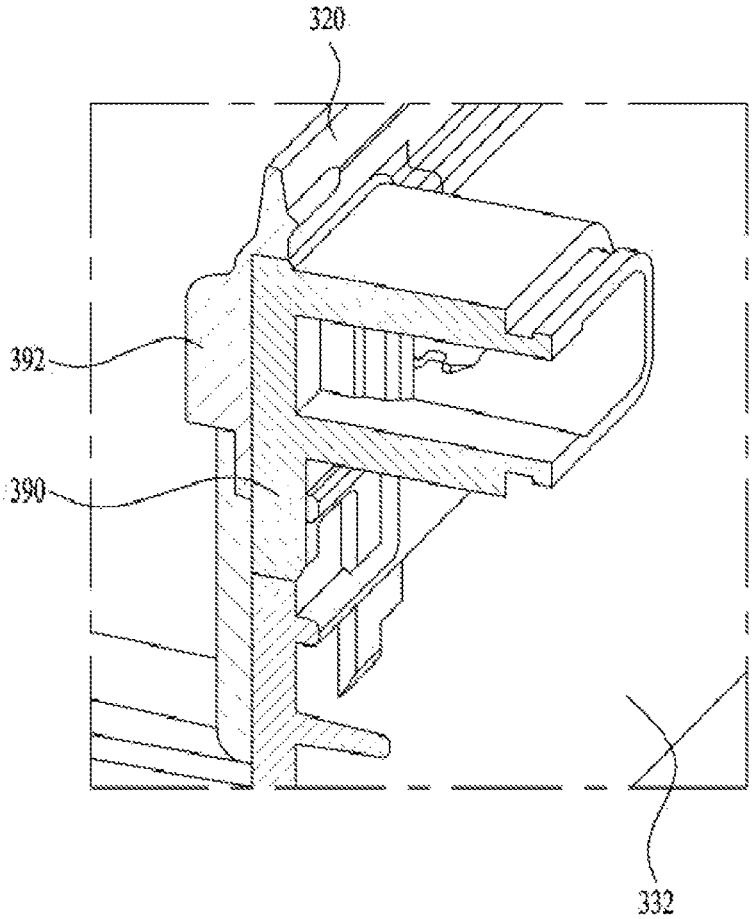
FIG. 12 is a cross-sectional perspective view of a detecting sensor according to an embodiment of the present disclosure.

FIGS. 10 to 12 are enlarged views of a rear portion of a storage according to an embodiment of the present disclosure. A portion A in FIG. 6 is enlarged. FIG. 10 is a perspective view of a cross-section in a direction C in FIG. 7. FIG. 12 is a perspective view of a cross-section of a detecting sensor.

Referring to FIGS. 10 to 12, the storage 300 of the laundry treating apparatus 1 according to an embodiment of the present disclosure may further include the detergent valve 380 that penetrates the rear outer wall 332 and regulates the discharge of the detergent stored in the first storage space S1 or the second storage space S2.

The detergent valve 380 may serve to guide the detergent stored in the first storage space S1 or the second storage space S2 to the tub 20. A separate pump (not shown) is coupled to the detergent valve 380, so that detergent in an amount required for the washing process may be discharged from the first storage space S1 or the second storage space S2. The third storage space S3 has the separate through-hole, so that the detergent stored inside may be supplied to tub 20. Thus, the separate detergent valve 380 may not be needed.

In addition, a detecting sensor 390 that is disposed on the rear outer wall 332, and detects the amount of detergent stored in the first storage space S1 or the second storage space S2 through a sensor electrode 391 may be further included. In addition, the detecting sensor 390 may have an exposed surface exposed to the detergent storage space S on at least a portion of a front surface thereof on which the sensor electrode 391 is disposed.

The detecting sensor 390 may detect the amount of detergent using the sensor electrode 391. For example, when the sensor electrode 391 is formed of two different terminals and detergent with a vertical level higher than a vertical level of the sensor electrode 391 is stored, the two terminals are connected to each other by the detergent and current flows. However, when the vertical level of the detergent is lower than that of the sensor electrode 391, the current does not flow. Using the same principle as above, it is possible to inform the user to supply the detergent when the current does not flow through the sensor electrode 391.

However, the present disclosure is not limited thereto. The amount of detergent stored in the first storage space S1 or the second storage space S2 may be detected in various schemes using the sensor electrode 391, and whether the detergent supplementation is necessary may be informed to the user through a separate controller based on the detected information. The user may supplement the insufficient detergent in the first storage space S1 or the second storage space S2 in response to the notification as above.

The rear outer wall 332 may further include a sensor rib 392 that protrudes from the rear outer wall 332 toward the detergent storage space S, extends across the exposed surface of the detecting sensor 390, and supports the detecting sensor 390.

The detecting sensor 390 may be integrally formed with the storage frame 310 through injection molding. Accordingly, the detecting sensor 390 may form a portion of the rear outer wall 332. In this case, the detecting sensor 390 may be vulnerable to an external force in the front and rear direction. To compensate for this, the sensor rib 392 may be formed to support the detecting sensor 390.

When the detecting sensor 390 forms the portion of the rear outer wall 332, the sensor rib 392 may be formed to cross the detecting sensor 390 and extend from the rear outer wall 332 excluding the detecting sensor 390.

In addition, at least a portion of the sensor rib 392 may be disposed upwardly and laterally of the sensor electrode 391 to prevent the detergent on the rear outer wall 332 from flowing to the sensor electrode.

As described above, the detecting sensor 390 may detect that the detergent is sufficient when the current flows as the terminals of the sensor electrode 391 are connected to each other with the detergent, and detect that the detergent is insufficient when the current does not flow as the terminals are not connected to each other with the detergent.

However, even when the actual vertical level of the detergent is lower than that of the sensor electrode 391, when the detergent remains on the wall surface by viscosity thereof and connects the terminals of the sensor electrode 391 to each other, it may be detected that the detergent is sufficient. Accordingly, the sensor rib 392 may be formed upwardly and laterally of the sensor electrode 391 to prevent such a detection error.

The sensor rib 392 may be formed to surround upper and side portions of the terminal of the sensor electrode 391. In addition, the sensor rib 392 formed upwardly of the sensor electrode 391 may be formed to be inclined downward to induce the detergent at an upper portion of the sensor rib 392 to flow downward along the inclined surface as the vertical level of the detergent gradually decreases.

As such, accuracy of the detecting sensor 390 may be improved by the sensor rib 392, and the detecting sensor 390 may be disposed in each of the first storage space S1 and the second storage space S2 to inform the user of a detergent supply required time. Accordingly, there is an effect of increasing the user convenience.

Although the present disclosure has been illustrated and described in relation to a specific embodiment, within the limits that do not depart from the technical spirit of the present disclosure provided by the following claims, it will be apparent to those of ordinary skill in the art that the present disclosure may be variously improved and changed.

What is claimed is:

1. A laundry treating apparatus comprising:

a cabinet that defines a detergent opening at a front surface thereof;

a tub located inside the cabinet and configured to receive wash water;

a drum rotatably disposed inside the tub and configured to receive laundry; and a detergent storage configured to be inserted into and withdrawn from the cabinet through the detergent opening and to receive detergent to be supplied to the tub, the detergent storage comprising:

a storage frame that defines a detergent storage space configured to store the detergent therein, the detergent storage space having an open top surface defined at a frame top surface of the storage frame, a cover seat portion that is disposed at the storage frame and extends along a perimeter of the detergent storage space, and a cover configured to detachably couple to the cover seat portion and to cover at least a portion of the open top surface of the detergent storage space, wherein the storage frame comprises:

a frame bottom surface, a frame partition wall that extends upward from the frame bottom surface and divides the detergent storage space into a plurality of storage spaces, a frame outer wall that extends upward from edges of the frame bottom surface to the frame top surface to thereby define the detergent storage space, wherein the cover seat portion is disposed at top portions of the frame outer wall and the frame partition wall, wherein the frame outer wall comprises:

a front outer wall disposed at a front surface of the storage frame facing the detergent opening of the cabinet, a rear outer wall disposed at a rear surface of the storage frame opposite to the front surface of the storage frame, and a first side outer wall and a second side outer wall that are disposed at side surfaces of the storage frame, wherein the cover comprises:

a cover base that extends parallel to the frame bottom surface and is configured to cover the open top surface of the detergent storage space, and a cover coupling portion that extends along a perimeter of the cover base and is configured to couple to a portion of the first side outer wall or the second side outer wall, the cover coupling portion comprising (i) a coupling insertion portion configured to receive the cover seat portion and (ii) a cover handle that extends from a rear portion of the first side outer wall or the second side outer wall outward relative to the coupling insertion portion in a direction away from the frame partition wall, and wherein the cover handle is configured (i) to be located inside the cabinet based on the detergent storage being inserted into the detergent opening and (ii) to be exposed to an outside of the cabinet based on the detergent storage being separated from the detergent opening.

2. The laundry treating apparatus of claim 1, wherein the frame partition wall comprises:

an auxiliary storage partition wall that is spaced apart from each of the front outer wall and the rear outer wall and surrounds a portion of the detergent storage space, a front partition wall that connects the front outer wall to the auxiliary storage partition wall, and a rear partition wall that connects the rear outer wall to the auxiliary storage partition wall.

3. The laundry treating apparatus of claim 2, wherein the detergent storage space comprises:

a first storage space defined between the first side outer wall and the frame partition wall, a second storage space defined between the second side outer wall and the frame partition wall, and a third storage space surrounded by the auxiliary storage partition wall, and wherein the cover comprises:

a first cover configured to cover a first open top surface of the first storage space, and a second cover configured to cover a second open top surface of the second storage space.

4. The laundry treating apparatus of claim 3, wherein the cover seat portion comprises:

a first seat portion that is disposed at the frame partition wall and extends along a first perimeter of the first storage space, the first seat portion being configured to couple to the first cover; and a second seat portion that is disposed at the frame partition wall and extends along a second perimeter of the second storage space, the second seat portion being configured to couple to the second cover.

5. The laundry treating apparatus of claim 4, wherein the first seat portion defines an edge of a first closed cross-section that extends along an upper portion of the frame partition wall and an upper portion of the first side outer wall, and wherein the second seat portion defines an edge of a second closed cross-section that extends along the upper portion of the frame partition wall and an upper portion of the second side outer wall, the second closed cross-section being different from the first closed cross-section.

6. The laundry treating apparatus of claim 4, further comprising:

a fastening elastic portion disposed inside the cabinet, the fastening elastic portion being disposed above the storage frame and protruding toward the storage frame; and a fastening protrusion that is disposed in the storage frame and protrudes upward to the fastening elastic portion, the fastening protrusion being configured to be in contact with the fastening elastic portion based on the detergent storage being inserted into and withdrawn from the cabinet, wherein the fastening protrusion is disposed at the rear partition wall and disposed between the first seat portion and the second seat portion.

7. The laundry treating apparatus of claim 3, wherein the detergent storage further comprises a detergent valve that passes through the rear outer wall and is configured to regulate discharge of detergent stored in the first storage space or the second storage space.

8. The laundry treating apparatus of claim 1, wherein the storage frame further comprises a coupling rib that protrudes laterally from each of the first side outer wall and the second side outer wall and supports the cover coupling portion, and wherein the cover handle is spaced apart from the coupling rib.

9. The laundry treating apparatus of claim 1, further comprising a fixing assembly that is disposed inside the cabinet and configured to face the open top surface of the detergent storage based on the detergent storage being inserted into the cabinet, the fixing assembly comprising a stopper that protrudes toward the storage frame, wherein the detergent storage further comprises an extension limiting portion that protrudes toward the fixing assembly and that is configured to contact the stopper to thereby limit an extension distance of the detergent storage withdrawn from the cabinet.

10. The laundry treating apparatus of claim 9, wherein the cover handle is disposed rearward relative to the extension limiting portion.

11. The laundry treating apparatus of claim 9, wherein the cover base defines a detergent hole, and wherein the cover further comprises a detergent cap that is coupled to the cover base and covers the detergent hole, the detergent cap being disposed forward relative to the extension limiting portion.

12. The laundry treating apparatus of claim 1, wherein the cover seat portion protrudes toward the cover coupling portion, and wherein the cover coupling portion comprises:

a coupling guide portion that defines a guide surface inclined with respect to a protruding direction of the cover seat portion, the guide surface being configured to move the cover coupling portion toward a coupling position relative to the cover seat portion; and a coupling pressure portion configured to face the guide surface and press the cover seat portion.

13. The laundry treating apparatus of claim 12, wherein the cover seat portion comprises a pressing protrusion that protrudes toward the coupling pressure portion.

14. The laundry treating apparatus of claim 1, further comprising a detecting sensor disposed at a rear side of the storage frame, the detecting sensor comprising a sensor electrode disposed at a front surface of the detecting sensor and configured to detect an amount of detergent stored in the detergent storage space, wherein at least a portion of the front surface of the detecting sensor is exposed to the detergent storage space.

15. The laundry treating apparatus of claim 14, wherein the rear outer wall comprises a sensor rib that protrudes toward the detergent storage space and extends across the front surface of the detecting sensor, the sensor rib supporting the detecting sensor.

16. The laundry treating apparatus of claim 15, wherein at least a portion of the sensor rib is positioned upward and laterally outward relative to the sensor electrode and configured to block the detergent flowing from the rear outer wall toward the sensor electrode.

17. The laundry treating apparatus of claim 15, wherein at least a portion of the detecting sensor is disposed at an outside of the rear outer wall, and wherein the detergent storage further comprises a detergent valve that passes through the rear outer wall and that is disposed below the sensor electrode, the detergent valve being configured to regulate discharge of detergent stored in the detergent storage space.

18. A laundry treating apparatus comprising:

a cabinet that defines a detergent opening at a front surface thereof;

a tub located inside the cabinet and configured to receive wash water;

a drum rotatably disposed inside the tub and configured to receive laundry; and a detergent storage configured to be inserted into and withdrawn from the cabinet through the detergent opening and to receive detergent to be supplied to the tub, the detergent storage comprising:

a storage frame that defines a detergent storage space configured to store the detergent therein, the detergent storage space having an open top surface defined at a frame top surface of the storage frame, a cover seat portion that is disposed at the storage frame and extends along a perimeter of the detergent storage space, and a cover configured to detachably couple to the cover seat portion and to cover at least a portion of the open top surface of the detergent storage space, wherein the laundry treating apparatus further comprises a detecting sensor disposed at a rear side of the storage frame, the detecting sensor comprising a sensor electrode disposed at a front surface of the detecting sensor and configured to detect an amount of detergent stored in the detergent storage space, wherein the storage frame comprises a rear outer wall disposed at the rear side of the storage frame, the rear outer wall comprising a sensor rib that protrudes toward the detergent storage space and extends across the front surface of the detecting sensor, and wherein the sensor rib supports the detecting sensor, and at least a portion of the sensor rib is positioned upward and laterally outward relative to the sensor electrode and configured to block the detergent flowing from the rear outer wall toward the sensor electrode.

* * * * *